US007926926B2

(12) United States Patent
Ishizawa et al.

(10) Patent No.: US 7,926,926 B2
(45) Date of Patent: Apr. 19, 2011

(54) LIQUID CONTAINER

(75) Inventors: Taku Ishizawa, Matsumoto (JP); Satoshi Shinada, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 906 days.

(21) Appl. No.: 11/727,261

(22) Filed: Mar. 26, 2007

(65) Prior Publication Data

US 2007/0222833 A1 Sep. 27, 2007

(30) Foreign Application Priority Data

Mar. 24, 2006 (JP) ..... 2006-083051
Mar. 24, 2006 (JP) ..... 2006-083052

(51) Int. Cl.
*B41J 2/175* (2006.01)

(52) U.S. Cl. ..... 347/86

(58) Field of Classification Search ..... 347/86
See application file for complete search history.

(56) References Cited

U.S. PATENT DOCUMENTS 4,969,759 A 11/1990 Suzuki et al.
5,156,470 A 10/1992 Suzuki et al.
5,156,471 A 10/1992 Suzuki et al.
5,156,472 A 10/1992 Suzuki et al.
5,156,473 A 10/1992 Suzuki et al.
5,158,377 A 10/1992 Suzuki et al.
5,174,665 A 12/1992 Suzuki et al.
5,221,148 A 6/1993 Suzuki et al.
5,328,279 A 7/1994 Suzuki et al.
5,421,658 A 6/1995 Suzuki et al.
5,477,963 A 12/1995 Mochizuki et al.
5,488,401 A 1/1996 Mochizuki et al.
5,560,720 A 10/1996 Suzuki et al.
5,576,749 A 11/1996 Mochizuki et al.
5,590,510 A 1/1997 Mochizuki et al.
5,603,577 A 2/1997 Suzuki et al.
5,607,242 A 3/1997 Suzuki et al.
5,615,957 A 4/1997 Suzuki et al.
5,622,439 A 4/1997 Suzuki et al.
5,657,058 A 8/1997 Mochizuki et al.
5,682,189 A 10/1997 Takagi
5,790,158 A 8/1998 Shinada et al.
5,801,737 A 9/1998 Sato et al.
5,877,794 A 3/1999 Takagi
6,045,207 A 4/2000 Mochizuki et al.
6,070,976 A 6/2000 Takagi et al.
6,123,469 A 9/2000 Suzuki et al.

(Continued)

FOREIGN PATENT DOCUMENTS

CN 1241491 A 1/2000

(Continued)

*Primary Examiner* — Charlie Peng
(74) *Attorney, Agent, or Firm* — Sughrue Mion, PLLC

(57) ABSTRACT

A liquid container includes: a liquid containing chamber for containing a liquid therein; a liquid supply port for connecting to a liquid receiving portion of an apparatus and supplying the liquid to the apparatus; an atmosphere opening port for introducing external air into the liquid containing chamber through an atmosphere opening flow passage as the liquid is consumed, the atmosphere opening port being provided to be located at a lower surface of the liquid container in a gravity direction when the liquid container is mounted on the apparatus; a sealing film that is adhered to close the atmosphere opening port and is removable before the liquid container is connected to the apparatus; and a liquid trap chamber that is provided in the atmosphere opening flow passage to prevent liquid leakage from the atmosphere opening port.

21 Claims, 15 Drawing Sheets

U.S. PATENT DOCUMENTS

| | | | | |
|---|---|---|---|---|
| 6,145,974 | A | 11/2000 | Shinada et al. | |
| 6,176,629 | B1 | 1/2001 | Suzuki et al. | |
| 6,224,275 | B1 | 5/2001 | Suzuki et al. | |
| 6,231,248 | B1 | 5/2001 | Suzuki et al. | |
| 6,247,803 | B1 | 6/2001 | Kanaya et al. | |
| 6,450,631 | B1 * | 9/2002 | Hayashi et al. | 347/86 |
| 6,470,744 | B1 | 10/2002 | Usui et al. | |
| 6,554,411 | B1 * | 4/2003 | Hatasa et al. | 347/86 |
| 6,723,147 | B2 | 4/2004 | Mashiko et al. | |
| 6,726,315 | B2 | 4/2004 | Koizumi et al. | |
| 6,755,515 | B2 | 6/2004 | Usui et al. | |
| 6,793,330 | B2 | 9/2004 | Usui et al. | |
| 6,848,776 | B2 | 2/2005 | Nishioka et al. | |
| 7,097,293 | B2 | 8/2006 | Ichihashi et al. | |
| 7,125,108 | B2 * | 10/2006 | Toba et al. | 347/86 |
| 7,147,309 | B2 | 12/2006 | Sakai | |
| 7,222,949 | B2 | 5/2007 | Ichihashi | |
| 7,249,832 | B2 | 7/2007 | Sakai | |
| 7,300,142 | B1 | 11/2007 | Usui et al. | |
| 7,328,987 | B2 * | 2/2008 | Katayama et al. | 347/86 |
| 7,445,323 | B2 * | 11/2008 | Anderson et al. | 347/86 |
| 2004/0169708 | A1 * | 9/2004 | Ichihashi et al. | 347/86 |
| 2005/0041077 | A1 | 2/2005 | Lee | |
| 2005/0104942 | A1 * | 5/2005 | Katayama et al. | 347/86 |
| 2005/0146579 | A1 * | 7/2005 | Sasaki et al. | 347/86 |
| 2006/0215002 | A1 | 9/2006 | Ishizawa et al. | |
| 2008/0036834 | A1 | 2/2008 | Usui et al. | |

FOREIGN PATENT DOCUMENTS

| | | | |
|---|---|---|---|
| CN | 1274645 | A | 11/2000 |
| CN | 1116987 | C | 8/2003 |
| CN | 1440875 | A | 9/2003 |
| EP | 0956965 | A2 | 11/1999 |
| JP | 54-61934 | A | 5/1979 |
| JP | 6-255122 | A | 9/1994 |
| JP | 2563769 | B2 | 9/1996 |
| JP | 10-095128 | A | 4/1998 |
| JP | 11-129492 | A | 5/1999 |
| JP | 2001-328278 | A | 11/2001 |
| JP | 2002-036580 | A | 2/2002 |
| JP | 2003-112435 | A | 4/2003 |
| JP | 2004-209847 | A | 7/2004 |
| JP | 2004-237720 | A | 8/2004 |
| JP | 2004-249707 | A | 9/2004 |
| JP | 2005-161634 | A | 6/2005 |

* cited by examiner

LIQUID CONTAINER

BACKGROUND

1. Technical Field

The present invention relates to a liquid container that contains therein a liquid, such as ink or the like, and supplies the liquid to an apparatus on which the liquid container is mounted.

2. Related Art

As a liquid container, an ink cartridge that is used in an ink jet printer is exemplified. In an ink cartridge for an ink jet printer, an ink containing chamber that contains therein ink to be supplied to a printing head is formed in a container main body. When used, the ink cartridge is detachably fitted into and mounted on a cartridge mounting portion of the ink jet printer. Then, ink contained in the ink containing chamber is supplied to the printing head, and ink is ejected from nozzles at a target position of a medium to be printed, such as a paper or the like, according to driving of the printing head on the basis of print data transmitted from a host computer.

There have been many atmosphere opening type ink cartridges that are mounted on an ink jet printer. Such an atmosphere opening type ink cartridge includes, in a containing main body, which is detachably mounted on a cartridge mounting portion of a printer, an ink containing chamber that contains ink therein, an ink supply port that is provided to communicate with the ink containing chamber and is connected to an ink receiving portion of the cartridge mounting portion, and an atmosphere opening flow passage that communicates the ink containing chamber with the outside and introduces external air into the ink containing chamber as ink in the ink containing chamber is consumed.

Further, there is suggested an ink cartridge that has an air chamber provided at a lower position outside an ink containing chamber, and air-liquid separation films communicating the air chamber and the ink containing chamber by an exclusive-use air introduction, path. The air-liquid separation films having a relatively large area are provided on both side surfaces of the air chamber so as to transmit air but block the liquid (for example, see Patent Document 1).

Patent Document 1: JP-A-2004-209847

In general, in the ink cartridge, there are many cases where, when the liquid supply port is formed at the bottom surface, the atmosphere opening port is formed at the top surface. If the atmosphere opening port is formed at the top surface, ink rarely leaks from the ink cartridge.

However, when the openings are formed at the top and bottom surfaces of the ink cartridge, a mold for forming the cartridge may be complicated, and a variation in molding accuracy of the ink cartridge may occur, which may cause an increase in manufacturing cost. Accordingly, there is suggested a method that provides the atmosphere opening port may be formed at a place other than the top surface, for example, at the bottom surface. However, if the atmosphere opening port is provided at the bottom surface, ink leakage may easily occur.

In addition, in the atmosphere opening type ink cartridge, the atmosphere opening port is generally sealed by a sealing film or the like so as to prevent ink evaporation or leakage in the ink containing chamber before the ink cartridge is used. Then, the sealing film is removed before the ink cartridge is mounted on the ink jet printer, and the ink cartridge is used in a state where the internal ink containing chamber communicates with the outside through the atmosphere opening port.

Here, if the ink cartridge is mounted on the ink jet printer with the atmosphere opening port sealed, ink cannot be supplied from the ink cartridge to the ink jet printer, and a trouble may occur in the printing head. Accordingly, in an ink jet printer, when the ink cartridge is mounted on the ink jet printer, the sealing film is torn off by an ink cartridge cover, such that the atmosphere opening port communicates with the outside even though the sealing film is not removed (for example, see Patent Documents 2 and 3).

Patent Document 2: JP-A-2002-36580

Patent Document 3: JP-A-11-129492

However, in the ink cartridge disclosed in Patent Document 2, since the sealing film is torn off by the ink cartridge cover, an operation force of a fixing lever for fixing the cover becomes large, and unfavorable operationality is obtained.

Further, after an ink supply needle of the ink jet printer is inserted into the ink supply port of the ink cartridge and an ink path communicates the ink cartridge and the ink jet printer with each other, the sealing film is torn off, and the ink cartridge is opened to the atmosphere.

Meanwhile, when a large amount of air is dissolved in ink to be supplied to a recording head, air bubbles may occur in the recording head due to a small change in pressure and printing quality may be degraded. For this reason, an ink cartridge is preferably packed in a compressed pack that is compressed and sealed to have an internal air pressure equal to or less than an atmospheric pressure. The internal air pressure of the ink cartridge is lowered to a regular value or less by a negative absorption force of the compressed pack, and the amount of air dissolved in ink is suppressed to a regular value or less. However, if the ink cartridge is mounted on the ink jet printer in a state where the internal pressure of the ink cartridge is lower than the pressure of the ink flow passage of the ink jet printer, ink may be reversely absorbed from the ink jet printer toward the ink cartridge. In this case, as occasion demands, air bubbles that have an adverse effect on printing quality may occur in the head, and thus there is much room for improvement.

SUMMARY

A first advantage of some aspects of the invention is to provide a liquid container that can be easily manufactured without complicating a mold for manufacturing and can prevent leakage of a liquid, such as ink or the like, from occurring. A second advantage of some aspects of the invention is to provide a liquid container, such as an ink cartridge or the like, which is easily and reliably opened to the atmosphere and does not cause any trouble in an ink flow passage when mounted on an ink jet printer.

The at least one of the advantages can be attained by at least one of the following aspects:

(1) A first aspect of the invention provides a liquid container comprising: a liquid containing chamber for containing a liquid therein; a liquid supply port for connecting to a liquid receiving portion of an apparatus and supplying the liquid to the apparatus; an atmosphere opening port for introducing external air into the liquid containing chamber through an atmosphere opening flow passage as the liquid is consumed, the atmosphere opening port being provided to be located at a lower surface of the liquid container in a gravity direction when the liquid container is mounted on the apparatus; a sealing film that is adhered to close the atmosphere opening port and is removable before the liquid container is connected to the apparatus; and a liquid trap chamber that is provided in the atmosphere opening flow passage to prevent liquid leakage from the atmosphere opening port.

(2) According to a second aspect of the invention, the liquid container according to the first aspect of the invention may further include a differential pressure valve that is provided between the liquid containing chamber and the liquid supply port to set a pressure of the liquid to be supplied to the liquid supply port in a negative pressure state.

(3) According to a third aspect of the invention, in the liquid container according to the first or second aspect of the invention, at least a portion of the atmosphere opening flow passage may pass through an uppermost portion of the liquid container in the gravity direction.

(4) According to a fourth aspect of the invention, the liquid container according to any one of the first to third aspects of the invention may further include an air-liquid separation filter that is provided in the atmosphere opening flow passage to transmit air but block the liquid.

(5) According to a fifth aspect of the invention, in the liquid container according to any one of the first to fourth aspects of the invention, a label that indicates a model number or the kind of the liquid may be provided substantially all over a surface of the liquid container facing a surface where the atmosphere opening port is formed.

(6). According to a sixth aspect of the invention, a liquid container comprising: a liquid containing chamber; a liquid supply port; an atmosphere opening port provided to be located at a surface of the liquid container where the liquid supply port is formed and connected to an atmosphere opening flow passage; a liquid trap chamber that is provided in the atmosphere opening flow passage to prevent liquid leakage from the atmosphere opening port; and a connection buffer chamber located between the liquid containing chamber and the liquid trap chamber.

(7). According to a seventh aspect of the invention, in the liquid container according to the sixth aspect of the invention, the liquid containing chamber may include an upper liquid containing chamber and a lower liquid containing chamber, and the connection buffer chamber may be connected to the upper liquid containing chamber.

(8). According to an eighth aspect of the invention, in the liquid container according to the seventh aspect of the invention, the connection buffer chamber may be connected to a bottom portion of the upper liquid containing chamber.

(9) According to a ninth aspect of the invention, in the liquid container according to any one of the sixth to eighth aspects of the invention, the liquid container may further comprise a dam portion between the liquid trap chamber and the connection chamber.

(10) According to a tenth aspect of the invention, in the liquid container according to any one of the sixth to ninth aspects of the invention, an air inlet hole and an air outlet hole of the liquid trap chamber may be located offset with respect to a direction perpendicular to an insertion direction when the liquid container is attached to an apparatus.

(11) According to an eleventh aspect of the invention, in the liquid container according to any one of the sixth to tenth aspects of the invention, the liquid container may further comprise a sealing film that is adhered to close the atmosphere opening port and is removable before the liquid container is attached to an apparatus.

(12) According to a twelfth aspect of the invention, in the liquid container according to any one of the sixth to eleventh aspects of the invention, the liquid container may further comprise a differential pressure valve that is provided between the liquid containing chamber and the liquid supply port.

(13) According to a thirteenth aspect of the invention, in the liquid container according to any one of the sixth to twelfth aspects of the invention, the liquid container may further comprise a decompression hole connecting to the connection buffer chamber.

(14). A fourteenth aspect of the invention provides a liquid container comprising: a liquid containing chamber containing a liquid therein; a liquid supply port for connecting to a liquid receiving portion of an apparatus and supplying the liquid to the apparatus; an atmosphere opening port that is provided on a plane where the liquid supply port is formed and is adapted to introduce external air into the liquid containing chamber through an atmosphere opening flow passage as the liquid is consumed; a sealing film that seals the atmosphere opening port and is removable before the liquid container is connected to the apparatus; and a concave portion formed at the plane where the atmosphere opening port is formed, into which a convex portion of the apparatus can be fitted, wherein the sealing film seals the concave portion and the atmosphere opening port together.

(15). According to a fifteenth aspect of the invention, in the liquid container according to the fourteenth aspect of the invention, a liquid trap chamber for preventing leakage of the liquid from the atmosphere opening port is provided in the atmosphere opening flow passage may be provided.

(16). According to a sixteenth aspect of the invention, in the liquid container according to the fifteenth aspect of the invention, a mounting direction when the liquid container is mounted on the apparatus may be downward in a gravity direction.

(17). According to a seventeenth aspect of the invention, in the liquid container according to the fourteenth aspect of the invention, at least a portion of the atmosphere opening flow passage may pass through an uppermost portion of the liquid container in a gravity direction.

(18). According to an eighteenth aspect of the invention, in the liquid container according to the fourteenth aspect of the invention, an air-liquid separation filter that transmits air but blocks the liquid may be provided in the atmosphere opening flow passage.

(19). According to a nineteenth aspect of the invention, in the liquid container according to the fourteenth aspect of the invention, the concave portion may be a hole, and the hole may form the atmosphere opening port.

(20). According to a twentieth aspect of the invention, in the liquid container according to the nineteenth aspect of the invention, a length of the hole may be 5 mm or more in an approaching direction of the convex portion.

(21). According to a twenty first aspect of the invention, in the liquid container according to the fourteenth aspect of the invention, the concave portion may be a guide groove for guiding the convex portion of the apparatus to mount the liquid container on the apparatus.

(22). According to a twenty second aspect of the invention, in the liquid container according to the twenty first aspect of the invention, the length of the guide groove may be 10 mm or more in an approaching direction of the convex portion.

(23). According to a twenty third aspect of the invention, in the liquid container according to the twenty second aspect of the invention, the liquid container may be packed in a compressed pack that is compressed and sealed to have an internal air pressure equal to or less than an atmospheric pressure.

(24). According to a twenty fourth aspect of the invention, in the liquid container according to the fourteenth aspect of the invention, the convex portion of the apparatus may be an erroneous insertion preventing projection for mounting the liquid container in a correct position, and the concave portion can accept the erroneous insertion preventing projection when the liquid container is correctly mounted to the apparatus. In the liquid container according to the first aspect of the invention, since the atmosphere opening port is formed on the same plane as the liquid supply port, it is not necessary to use a complex mold having a pattern for forming holes at a plurality of surfaces when the liquid container is molded. Therefore, a manufacturing process can be simplified and manufacturing costs can be suppressed.

In the liquid container according to the first aspect of the invention, in order to suppress liquid leakage when the atmosphere opening port is provided at the lower surface in the gravity direction, the liquid trap chamber is provided in the atmosphere opening flow passage to prevent liquid leakage from the atmosphere opening port. Therefore, even though the liquid flows out from the liquid containing chamber to a side of the atmosphere opening port due to thermal expansion or the like, the liquid is reliably trapped by the liquid trap chamber, and thus liquid leakage can be prevented from occurring. Further, since the liquid that is trapped by the liquid trap chamber flows into the liquid containing chamber as the liquid is consumed, the liquid contained therein can be used with no waste.

The invention can be suitably used for a liquid container having a differential pressure valve. That is, in the liquid container having the differential pressure valve, ink leakage from the atmosphere opening port may occur, compared with the liquid container having a foam as a negative pressure generation device. In this case, however, with the liquid trap chamber, liquid leakage can be reliably prevented.

In the liquid container according to the third aspect of the invention, at least a portion of the atmosphere opening flow passage passes through the uppermost portion of the liquid container in the gravity direction. Therefore, even though the liquid flows backward, the liquid does not reach the atmosphere opening port beyond the uppermost portion in the gravity direction. As a result, the liquid leakage can be suppressed.

In the liquid container according to the fourth aspect of the invention, when the liquid flows out to the atmosphere opening port, since the air-liquid separation filter is provided in front of the atmosphere opening port, the liquid does not leak to the atmosphere opening port beyond the air-liquid separation filter. Therefore, ink leakage from the atmosphere opening port can be more reliably suppressed.

The label that indicates the model number or the kind of the liquid is provided substantially all over the surface of the container main body facing the surface where the atmosphere opening port is formed. Like the above-described configuration, if the atmosphere opening port is provided at the lower surface in the gravity direction, any structure does not need to be provided on the top surface. Therefore, the surface of the container main body facing the surface where the atmosphere opening port is formed can be efficiently used, and a label that is easily recognized by a user can be adhered thereto. As a result, the liquid container can be prevented from being erroneously attached.

In the liquid container according to the sixth to thirteenth aspects of the invention, since the atmosphere opening port is formed on the same plane as the liquid supply port, it is not necessary to use a complex mold having a pattern for forming holes at a plurality of surfaces when the liquid container is molded. Therefore, a manufacturing process can be simplified and manufacturing costs can be suppressed.

In the liquid container according to the sixth to thirteenth aspects of the invention, in order to suppress liquid leakage, the liquid trap chamber and the connection buffer chamber are provided in the atmosphere opening flow passage to prevent liquid leakage from the atmosphere opening port. Therefore, even though the liquid flows out from the liquid containing chamber to a side of the atmosphere opening port due to thermal expansion or the like, the liquid is reliably trapped by the liquid trap chamber, and thus liquid leakage can be prevented from occurring. Further, since the liquid that is trapped by the liquid trap chamber flows into the liquid containing chamber as the liquid is consumed, the liquid contained therein can be used with no waste.

In the liquid container according to the fourteenth aspect of the invention, the concave portion is formed at the surface of the liquid container where the atmosphere opening port is formed, and the convex portion provided in the apparatus, on which the liquid container is mounted, is fitted into the concave portion. Further, the sealing film seals the concave portion and the atmosphere opening port together. With this configuration, the liquid container cannot be mounted on the apparatus insofar as the sealing film is not removed. Therefore, even though a user tries to mount the liquid container on the apparatus in a state where the sealing film is not removed, the user can notice that the liquid container cannot be mounted on the apparatus, and at that time, he/she finds out a necessity to remove the sealing film. Then, if the sealing film is removed, the atmosphere opening port is unsealed naturally. Accordingly, there is no case where the liquid container is mounted on the apparatus in a state where the atmosphere opening port is sealed.

With the above-described configuration, when the liquid container is mounted on the apparatus, the sealing film should be removed before the liquid container is mounted on the apparatus. Accordingly, there is no case where the liquid supply port of the liquid container and the flow passage of the apparatus communicate with each other in a state where the atmosphere opening port is sealed. Further, a pressure in the liquid container immediately after the liquid container is opened to the atmosphere is substantially consistent with the atmospheric pressure. Accordingly, there is no case where the pressure of the liquid container becomes lower than the flow passage of the apparatus at the time when the liquid container and the apparatus are connected to each other. Therefore, even though the pressure in the liquid container is lowered before the sealing film is removed, there is no case where the liquid flows into the liquid container backward. As a result, the liquid container can be mounted on the apparatus without causing an adverse effect on the apparatus.

In the liquid container according to the fifteenth aspect of the invention, the liquid trap chamber is provided to prevent liquid leakage from the atmosphere opening port. Accordingly, even though the liquid leaks from the liquid containing chamber to the atmosphere opening port due to thermal expansion or the like, the liquid can be reliably trapped by the liquid trap chamber, and thus liquid leakage can be suppressed from occurring. Further, the liquid trapped by the liquid trap chamber flows into the liquid containing chamber as the liquid is consumed. Therefore, the liquid contained in the liquid container can be used with no waste.

According to the sixteenth aspect of the invention, in view of the layout of the printer, in a case where the mounting direction when the liquid container is mounted on the apparatus is downward in the gravity direction, the position where the atmosphere opening port is provided is located at a lower surface of the liquid container in the gravity direction, and ink may leak from the atmosphere opening port. However, with the above-described configuration, the liquid trap chamber is provided to prevent liquid leakage from the atmosphere opening port. Therefore, even though the liquid leaks from the liquid containing chamber toward the atmosphere opening port due to thermal expansion or the like, the liquid can be reliably trapped by the liquid trap chamber. As a result, liquid leakage can be suppressed from occurring.

In the liquid container according to the seventeenth aspect of the invention, at least a portion of the atmosphere opening flow passage passes through an uppermost portion of the liquid container in a gravity direction. Accordingly, even though the liquid flows backward, the liquid does not reach the atmosphere opening port beyond the uppermost portion in the gravity direction. Therefore, liquid leakage can be suppressed from occurring.

In the liquid container according to the eighteenth aspect of the invention, the air-liquid separation filter is provided in front of the atmosphere opening port. Accordingly, even though the liquid leaks to the atmosphere opening port, the liquid does not leak to the atmosphere opening port beyond the air-liquid separation filter. Therefore, ink leakage from the atmosphere opening port can be further suppressed.

In the liquid container according to the nineteenth aspect of the invention, the concave portion formed in the liquid container is a hole, and the hole forms the atmosphere opening port. In this case, the length of the hole in the convex portion approach direction is, for example, 5 mm or more.

In the liquid container according to the twenty-first aspect of the invention, the concave portion formed in the liquid container is the guide groove that guides the convex portion of the apparatus to mount the liquid container on the apparatus. In this case, the length of the guide groove in a convex portion approach direction is, for example, 10 mm or more.

In the liquid container according to the twenty-third aspect of the invention, the liquid container is packed in the compressed pack that is compressed and sealed to have the internal air pressure equal to or less than the atmospheric pressure. In this case, before the ink cartridge is used, the air pressure in the ink cartridge can be kept to be equal to or less than a regular value by a negative absorption force of the compressed pack, and ink having a small amount of dissolved air can be supplied. Further, immediately before ink cartridge is used, the sealing film is removed before the ink cartridge is mounted on the apparatus, and thus the pressure in the liquid container is substantially consistent with the atmospheric pressure. Therefore, the liquid does not flow into the liquid container backward. As a result, the liquid container can be mounted on the apparatus without causing an adverse effect on the apparatus.

In the liquid container according to the twenty-fourth aspect of the invention, the concave portion can exert the erroneous insertion prevention function as well as the unremoval prevention function.

The present disclosure relates to the subject matter contained in Japanese patent application Nos. JP 2006-083051 filed on Mar. 24, 2006 and JP 2006-083052 filed on Mar. 24, 2006, which are expressly incorporated herein by reference in its entirety.

BRIEF DESCRIPTION OF THE DRAWINGS

The invention will be described with reference to the accompanying drawings, wherein like numbers reference like elements.

DESCRIPTION OF EXEMPLARY EMBODIMENTS

An embodiment of a liquid container according to the invention will now be described with reference to the drawings. In the following embodiment, an example where an ink cartridge, which is mounted on an ink jet printer, is exemplified as the liquid container will be described.

Figure 1:
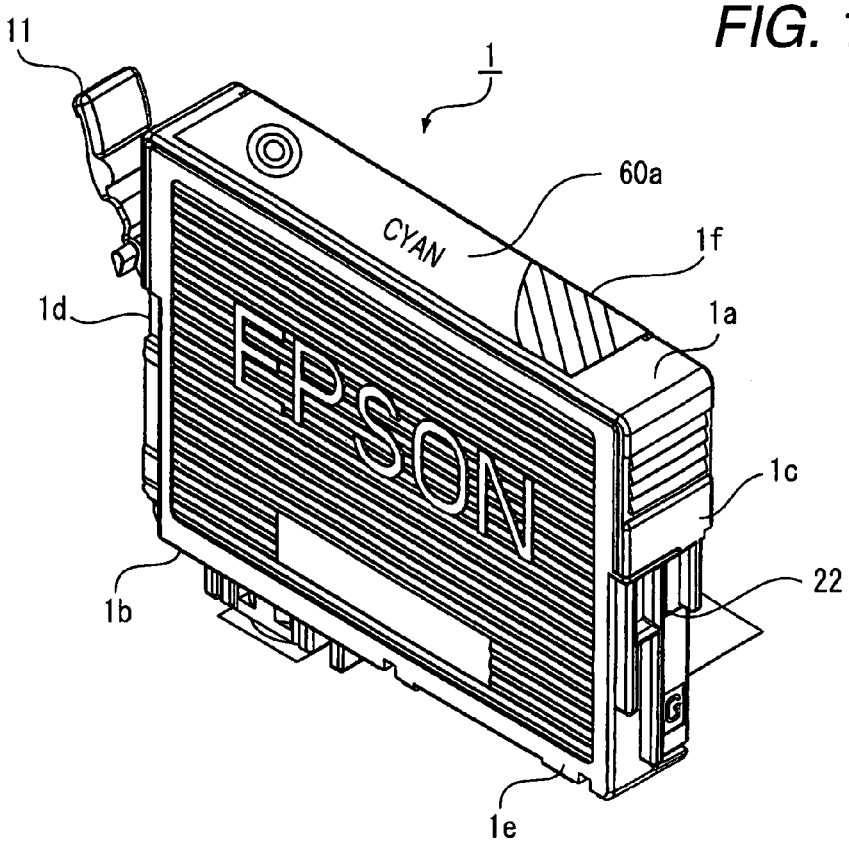
FIG. 1 is an exterior perspective view of an ink cartridge according to an embodiment of the invention.
Figure 2:
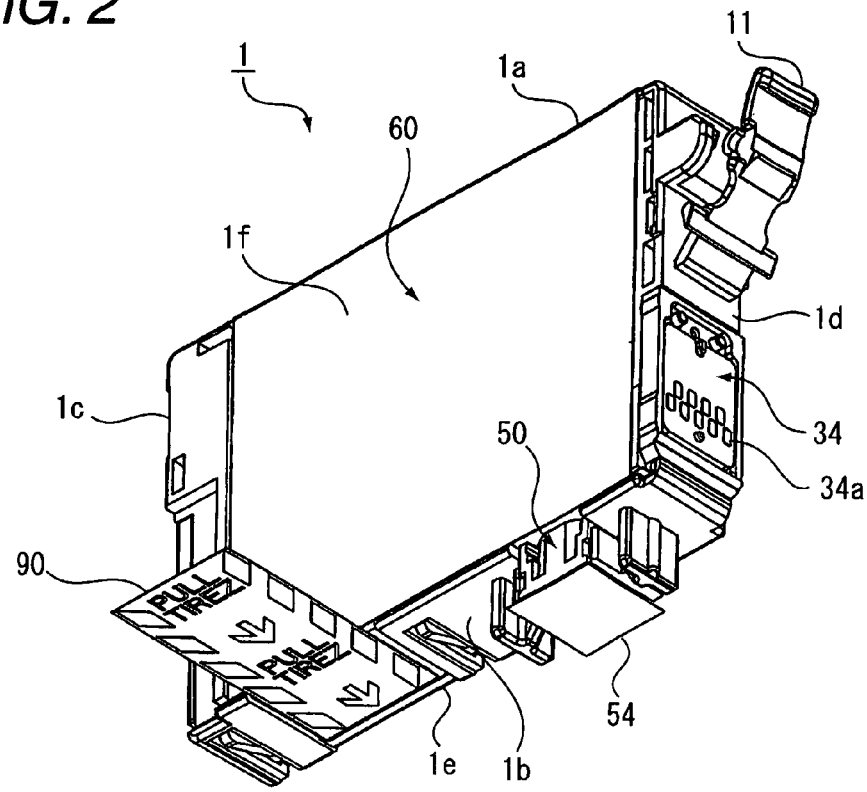
FIG. 2 is an exterior perspective view of the ink cartridge according to the embodiment of the invention as viewed from a direction opposite to FIG. 1.
Figure 3:
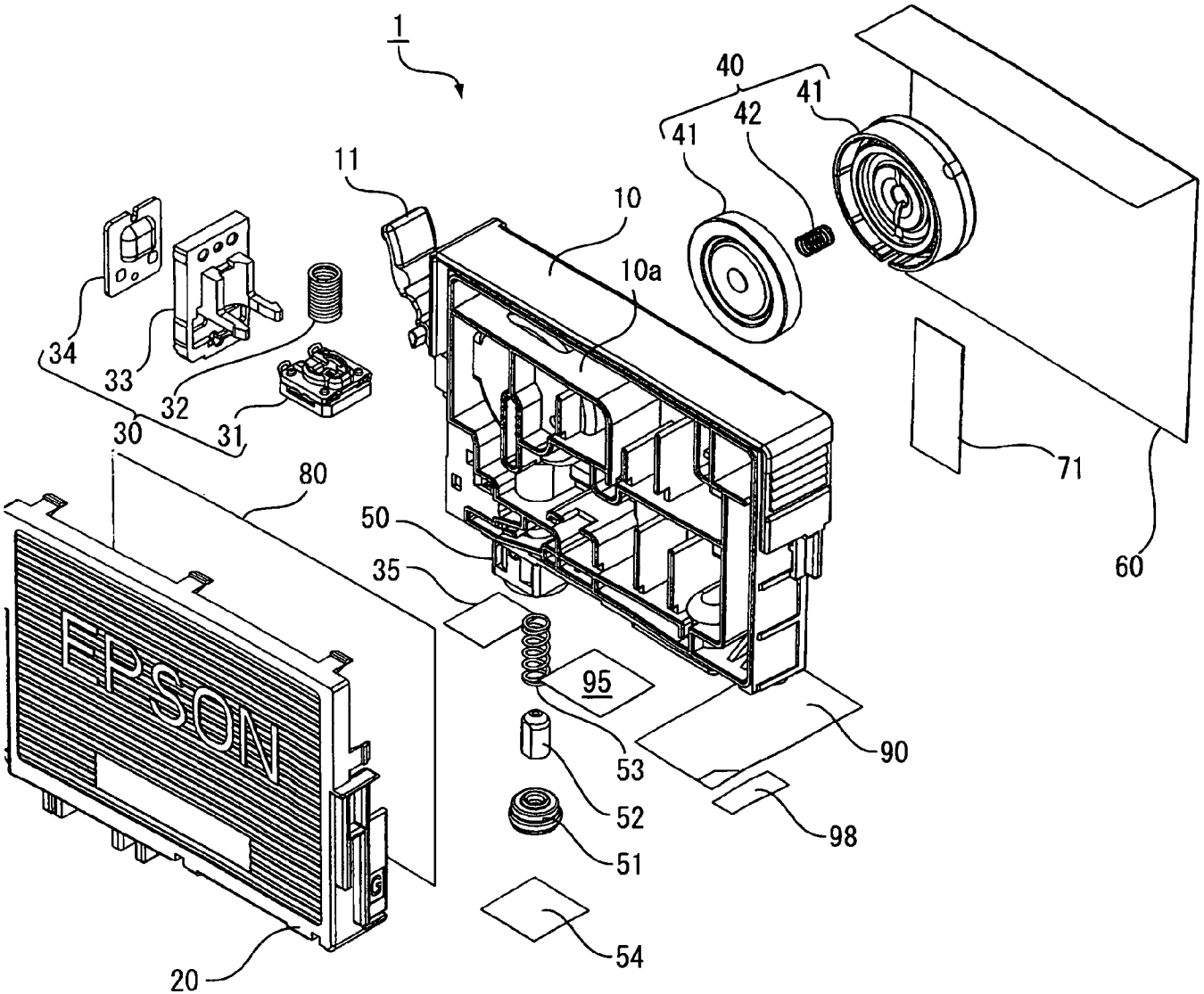
FIG. 3 is an exploded perspective view of the ink cartridge according to the embodiment of the invention.
Figure 4:
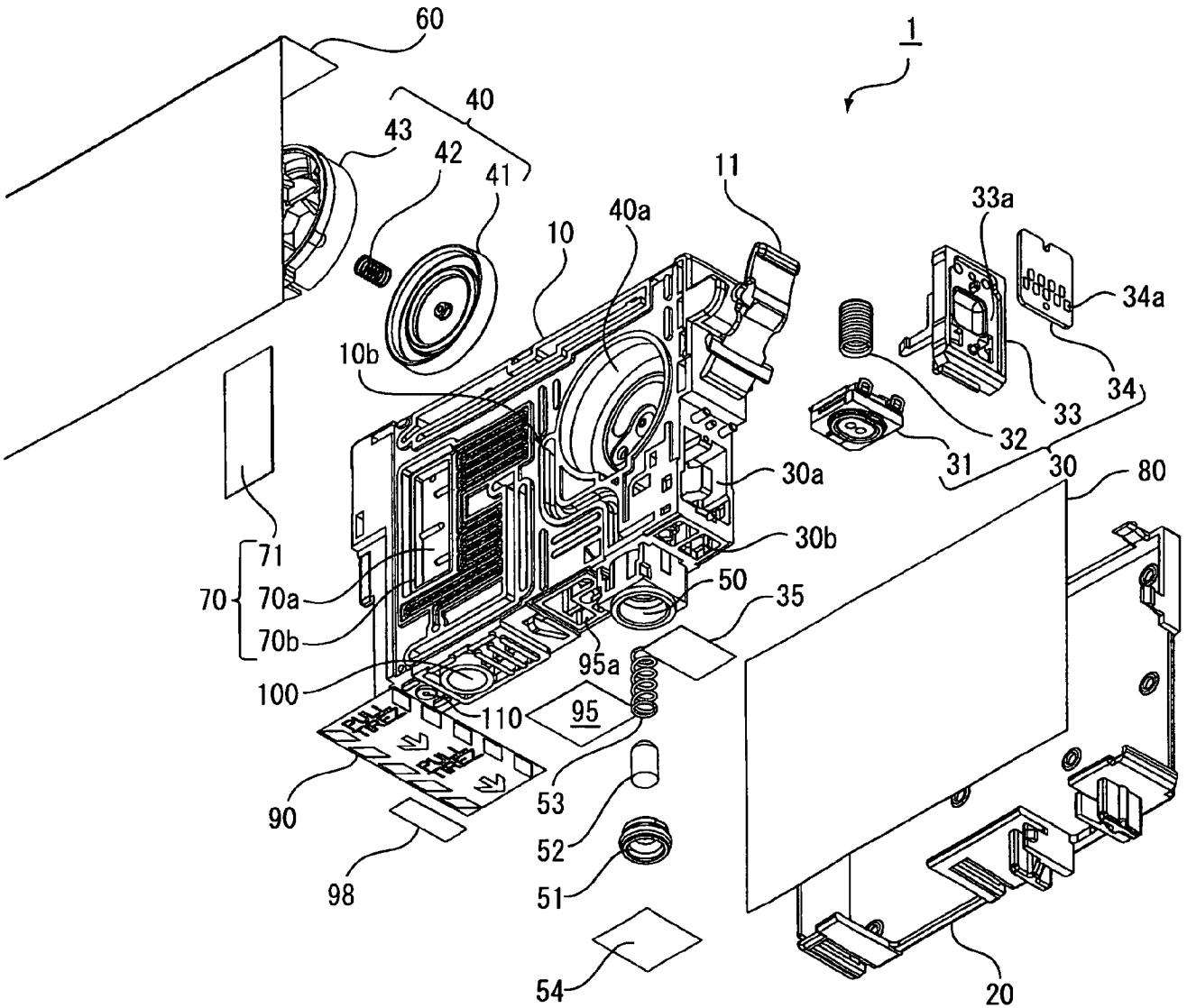
FIG. 4 is an exploded perspective view of the ink cartridge according to the embodiment of the invention as viewed from a direction opposite to FIG. 3.
Figure 5:
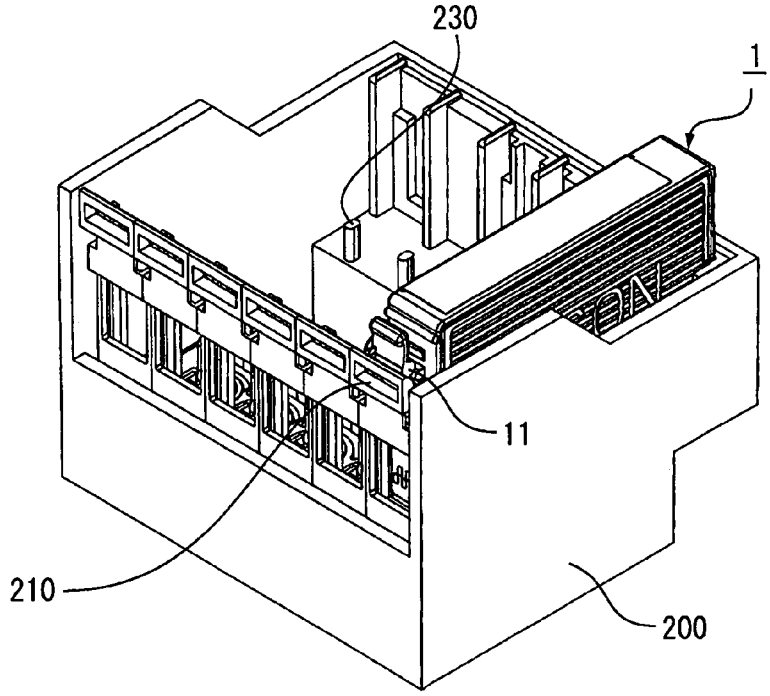
FIG. 5 is a diagram showing a state where the ink cartridge according to the embodiment of the invention is attached to a carriage.
Figure 6:
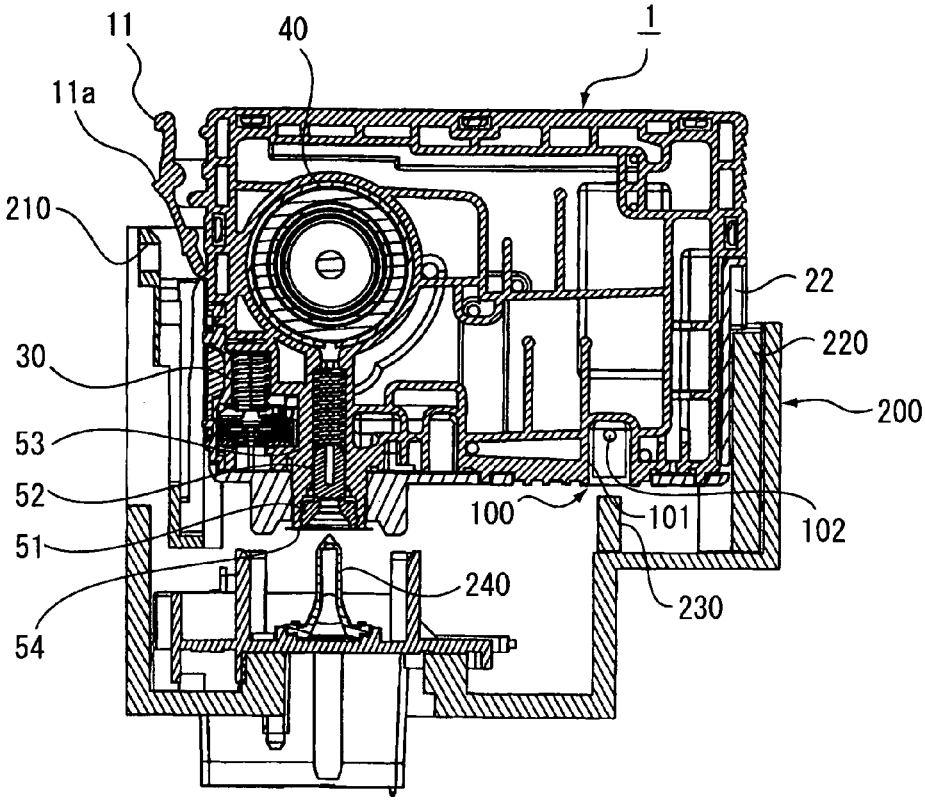
FIG. 6 is a diagram showing a state immediately before the ink cartridge according to the embodiment of the invention is attached to the carriage.
Figure 7:
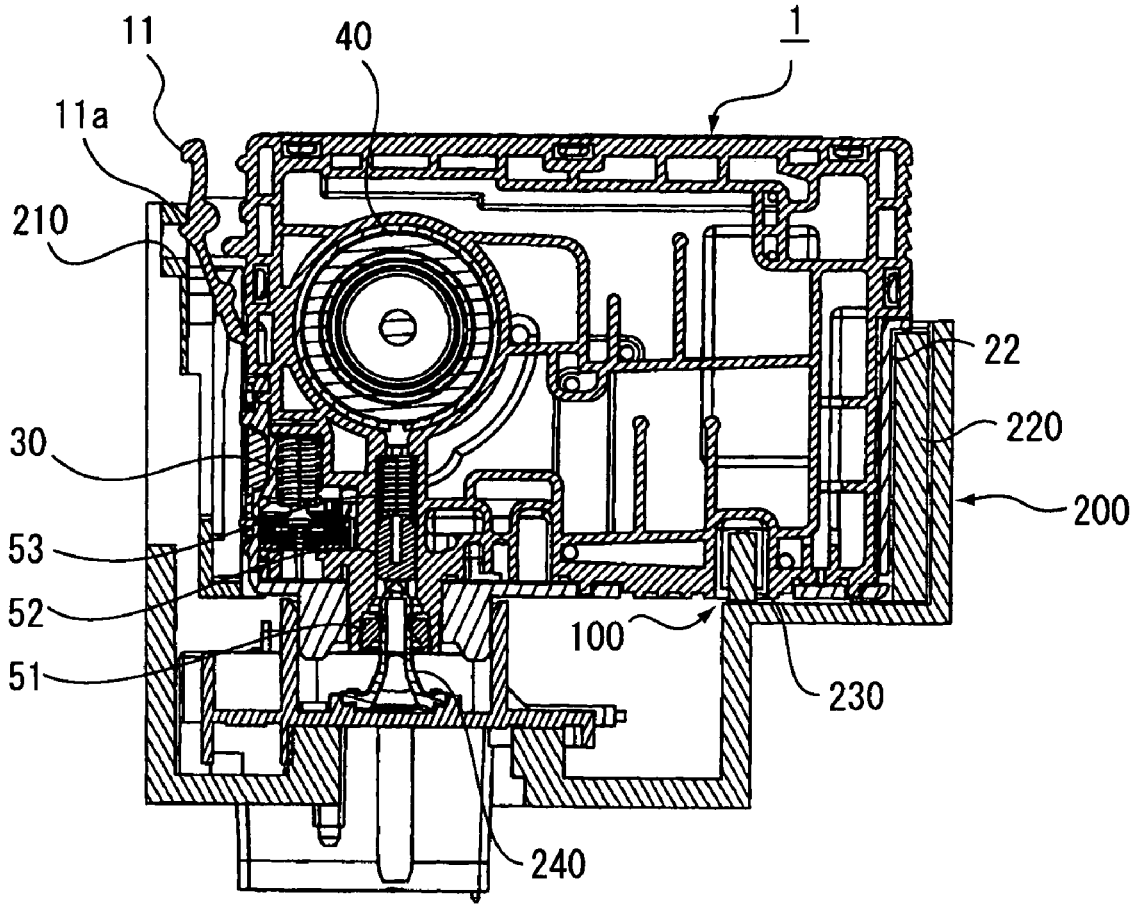
FIG. 7 is a diagram showing a state immediately after the ink cartridge according to the embodiment of the invention is attached to the carriage.

FIG. 1 is an external perspective view of an ink cartridge according to this embodiment. FIG. 2 is an exterior perspective view of the ink cartridge according to this embodiment as viewed from a direction opposite to FIG. 1. FIG. 3 is an exploded perspective view of the ink cartridge according to this embodiment. FIG. 4 is an exploded perspective view of the ink cartridge according to this embodiment as viewed from a direction opposite to FIG. 3. FIG. 5 is a diagram showing a state where the ink cartridge according to this embodiment is attached to a carriage. FIG. 6 is a cross-sectional view showing a state immediately before the ink cartridge according to this embodiment is attached to the carriage. FIG. 7 is a cross-sectional view showing a state immediately after the ink cartridge according to this embodiment is attached to the carriage.

As shown in FIGS. 1 and 2, the ink cartridge 1 of this embodiment is a liquid container that substantially has a rectangular parallelepiped shape and stores and contains ink in an ink containing chamber provided therein. The ink cartridge 1 is mounted on a carriage 200 that is provided in an ink jet printer, and supplies ink to the ink jet printer (see FIG. 5).

The exterior features of the ink cartridge 1 will be described. As shown in FIGS. 1 and 2, the ink cartridge 1 has a flat top surface 1*a* and a bottom surface 1*b* facing the top surface 1*a*. An ink supply port 50 that is connected to the ink jet printer and supplies ink thereto is provided at the bottom surface 1*b*. An atmosphere opening port 100 that introduces air into the ink cartridge 1 is also provided at the bottom surface 1*b*. That is, the ink cartridge 1 is an opening type ink cartridge that supplies ink through the ink supply port 50 while introducing air through the atmosphere opening port 100. A label 60*a* that indicates the content of the ink cartridge is adhered to the top surface 1*a* of the ink cartridge 1.

In this embodiment, as shown in FIG. 6, the atmosphere opening port 100 has a substantially cylindrical concave portion (hole) 101 that is formed at the bottom surface 1*b* from the bottom surface toward the top surface, and a small hole 102 that is formed at an inner peripheral surface of the concave portion 101. The small hole 102 communicates with an atmosphere opening flow passage. Air is introduced into the ink containing chamber through the small hole 102.

The concave portion 101 of the atmosphere opening port 100 has a depth such a degree as to receive a protrusion 230 formed in the carriage 200. The protrusion 230 is an unremoval prevention protrusion that prevents a sealing film 90 for sealing the atmosphere opening port 100 from being unremoved. That is, in a state where the sealing film 90 is adhered, the protrusion 230 is not inserted into the atmosphere opening port 100, and thus the ink cartridge 1 is not attached to the carriage 200. Accordingly, even though the user tries to attach the ink cartridge 1 to the carriage 200 in a state where the sealing film 90 is adhered onto the atmosphere opening port 100, the ink cartridge 1 is not attached to the carriage 200. Then, the user can be urged to surely remove the sealing film 90 when the ink cartridge 1 is mounted.

As shown in FIG. 1, an erroneous insertion prevention protrusion 22 that prevents the ink cartridge 1 from being mounted at an incorrect position is formed at a narrow side surface 1*c* near one short side of the top surface 1*a* of the ink cartridge 1. As shown in FIG. 5, a concavo-convex 220 is formed in the carriage 200 serving as a recipient to correspond to the erroneous insertion prevention protrusion 22. The ink cartridge 1 is mounted on the carriage 200 only when the erroneous insertion prevention protrusion 22 and the concavo-convex 220 do not interfere with each other. The erroneous insertion prevention protrusion 22 has a different shape according to the kind of ink, and the concavo-convex 220 of the carriage 200 serving as a recipient has a shape according to the kind of ink. Therefore, as shown in FIG. 5, even though a plurality of ink cartridges are mounted on the carriage 200, the ink cartridge is not mounted at an incorrect position.

As shown in FIG. 2, an engagement lever 11 is provided at a narrow side surface id that faces the narrow side surface 1*c* of the ink cartridge 1. The engagement lever 11 is provided with a protrusion 11*a* that is engaged with a concave portion 210 formed in the carriage 200 when the ink cartridge 1 is mounted on the carriage 200. If the engagement lever 11 is bent and the protrusion 11*a* is engaged with the concave portion 210, the ink cartridge 1 is positioned and fixed with respect to the carriage 200.

A circuit board 34 is provided below the engagement lever 11. A plurality of electrode terminals 34*a* are formed on the circuit board 34. If the electrode terminals 34*a* come into contact with electrode members (not shown) provided in the carriage 200, the ink cartridge 1 is electrically connected to the ink jet printer. A data rewritable nonvolatile memory is provided in the circuit board 34 to store various kinds of information about the ink cartridge 1 or information about the use of ink of the ink jet printer. Further, on the rear side of the circuit board 34, a sensor unit 31 (see FIG. 3 or 4) is provided to detect an ink end in the ink cartridge 1 is provided. In the following description, the sensor unit 31 and the circuit board 34 are collectively referred to as an ink end sensor 30.

As shown in FIG. 1, the label 60*a* that indicates the content of the ink cartridge is adhered to the top surface 1*a* of the ink cartridge 1. The label 60*a* is formed by extending an end of an outer surface film 60, which covers a wide side surface 1*f*, astride the top surface 1*a*.

As shown in FIGS. 1 and 2, wide side surfaces 1*e* and 1*f* near two long sides of the top surface 1*a* of the ink cartridge 1 have flat surfaces. In the following description, for convenience, the side of the wide side surface 1*e* is referred to as a front surface side, and the side of the wide side surface 1*f* is referred to as a rear surface side. Further, the side of the narrow side surface 1*c* is referred to as a right surface side, and the side of the narrow side surface id is referred to as a left surface side.

Next, parts that constitute the ink cartridge 1 will be described with reference to FIGS. 3 and 4.

The ink cartridge 1 has a cartridge main body 10 and a cover member 20 that covers the front surface side of the cartridge main body 10.

The cartridge main body 10 is provided with ribs 10*a* having various shapes on the front surface side. The ribs 10*a* partition the inside of the container main body 10 to form a plurality of flow passages and the ink containing chamber. A film 80 is provided between the cartridge main body 10 and the cover member 20 to cover the front surface side of the cartridge main body 10. The film 80 seals the upper surfaces of the ribs, concave portions, and grooves, such that a plurality of flow passages or the ink containing chamber is formed.

A differential pressure valve accommodating chamber 40*a* as a concave portion accommodating a differential pressure valve 40 and an air-liquid separation chamber 70*a* as a concave portion constituting an air-liquid separation filter 70 are formed on the rear surface side of the cartridge main body 10.

A valve member 41, a spring 42, and a spring pedestal 43 are accommodated in the differential pressure valve accommodating chamber 40*a*, thereby forming the differential pressure valve 40. The differential pressure valve 40 is disposed between the downstream-side ink supply port 50 and the upstream-side ink containing chamber. If the downstream side is compressed relative to the upstream side, ink that is supplied to the ink supply port 50 has a negative pressure.

An air-liquid separation film 71 is adhered to the top surface of the air-liquid separation chamber 70*a* along a bank 70*b* that is provided near a central portion of the air-liquid separation chamber 70*a* to surround the periphery. The air-liquid separation film 71 is formed of a material that transmits air but blocks the liquid. The air-liquid separation film 71, the air-liquid separation chamber 70*a*, and the bank 70*b* form the air-liquid separation filter 70. The air-liquid separation filter 70 is provided in the atmosphere opening flow passage that connects the atmosphere opening port 100 and the ink containing chamber. The air-liquid separation filter 70 prevents ink in the ink containing chamber from leaking from the atmosphere opening port 100 through the atmosphere opening flow passage.

On the rear surface side of the cartridge main body 10, a plurality of grooves 10*b* are formed, in addition to the differential pressure valve accommodating chamber 40*a* and the air-liquid separation chamber 70*a*. In a state where the differential pressure valve 40 and the air-liquid separation filter 70 are formed, the outer surface is covered with the outer surface film 60, and then openings of the grooves 10*b* are sealed. Accordingly, the atmosphere opening flow passage or the ink flow passage is formed.

As shown in FIG. 4, a sensor chamber 30*a* serving as a concave portion that accommodates individual members constituting the ink end sensor 30 is formed on the right surface side of the cartridge main body 10. The sensor chamber 30*a* accommodates therein a sensor unit 31 that has a sensing member (not shown) for generating a vibration and detecting a residual vibration to detect presence/absence of ink, and a compressed spring 32 that presses the sensor unit against the inner wall surface of the sensor chamber 30*a* and fixes the sensor unit thereto. Further, an opening of the sensor chamber 30*a* is covered with a cover member 33, and the circuit board 34 is fixed on the outer surface 33*a* of the cover member 33. The sensing member of the sensor unit 31 is connected to the circuit board 34.

The ink end sensor 30 is provided in the ink flow passage between the ink containing chamber and the ink supply port 50. The ink end sensor 30 operates according to a driving signal that is supplied from the ink jet printer through the circuit board 34. The ink end sensor 30 detects a difference in amplitude or frequency of the residual vibration between the liquid and air so as to monitor the ink end.

At the bottom surface of the cartridge main body 10, in addition to the ink supply port 50 and the atmosphere opening port 100 described above, as shown in FIG. 4, a decompression hole 110 that is used to pump air out of the inside of the ink cartridge 1 through a vacuuming device and compress the ink cartridge 1 upon ink injection, a concave portion 95*a* that forms the ink flow passage from the ink containing chamber to the ink supply port 50, and a buffer chamber 30*b* that is provided below the ink end sensor 30 are formed.

Immediately after the ink cartridge is manufactured, the ink supply port 50, the atmosphere opening port 100, the decompression hole 110, the concave portion 95*a*, and the buffer chamber 30*b* are sealed by sealing films 54, 90, 98, 95, and 35, respectively. Among these, the sealing film 90 that seals the atmosphere opening port 100 is removed by the user before the ink cartridge is mounted on the ink jet printer for use. Accordingly, the atmosphere opening port 100 is exposed to the outside, and the ink containing chamber in the ink cartridge 1 communicates with external air through the atmosphere opening flow passage.

The sealing film 35 that is adhered to the outer surface of the ink supply port 50 is torn off by the ink supply needle 240 of the ink jet printer when the ink cartridge 1 is mounted on the ink jet printer.

In the ink supply port 50, a ring-shaped sealing member 51 that is pressed against the outer surface of the ink supply needle 240 upon mounting, a spring pedestal 52 that comes into contact with the sealing member 51 to close the ink supply port 50 when the ink cartridge 1 is not mounted on the printer, and a compressed spring 53 that urges the spring pedestal 52 to come into contact with the sealing member 51. As shown in FIGS. 6 and 7, if the ink supply needle 240 is inserted into the ink supply port 50, the inner periphery of the sealing member 51 and the outer periphery of the ink supply needle 240 are sealed, and a gap between the ink supply port 50 and the ink supply needle 240 is sealed liquid-tight. Further, the front end of the ink supply needle 51 comes into contact with the spring pedestal 52, presses the spring pedestal 52 upward, and unseals the spring pedestal 52 and the sealing member 51. Then, ink can be supplied from the ink supply port 50 to the ink supply needle 240.

Next, the internal structure of the ink cartridge 1 according to this embodiment will be described with reference to FIGS. 8 to 12.

Figure 8:
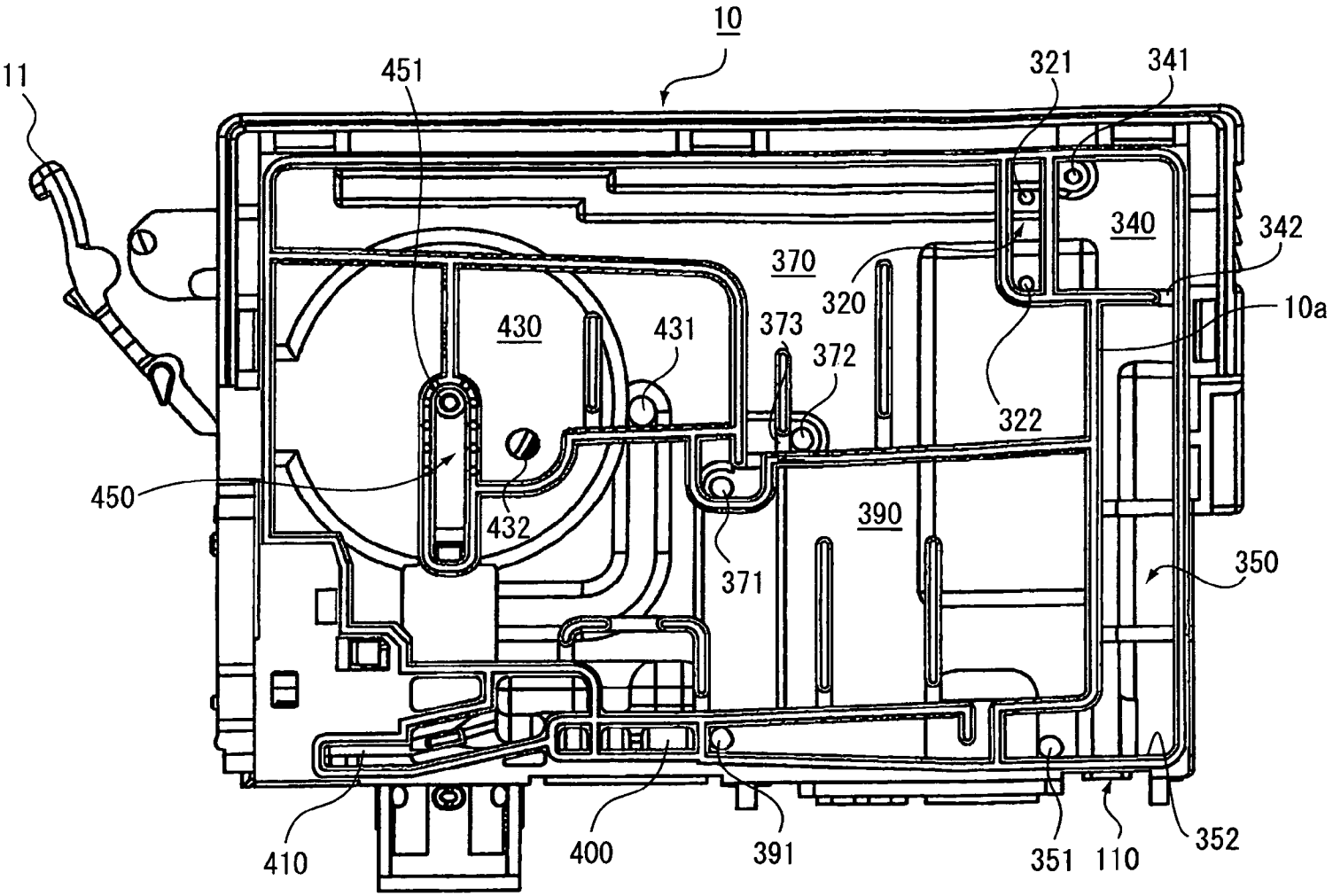
FIG. 8 is a diagram of a cartridge main body of the ink cartridge according to the embodiment of the invention as viewed from the front surface side.
Figure 9:
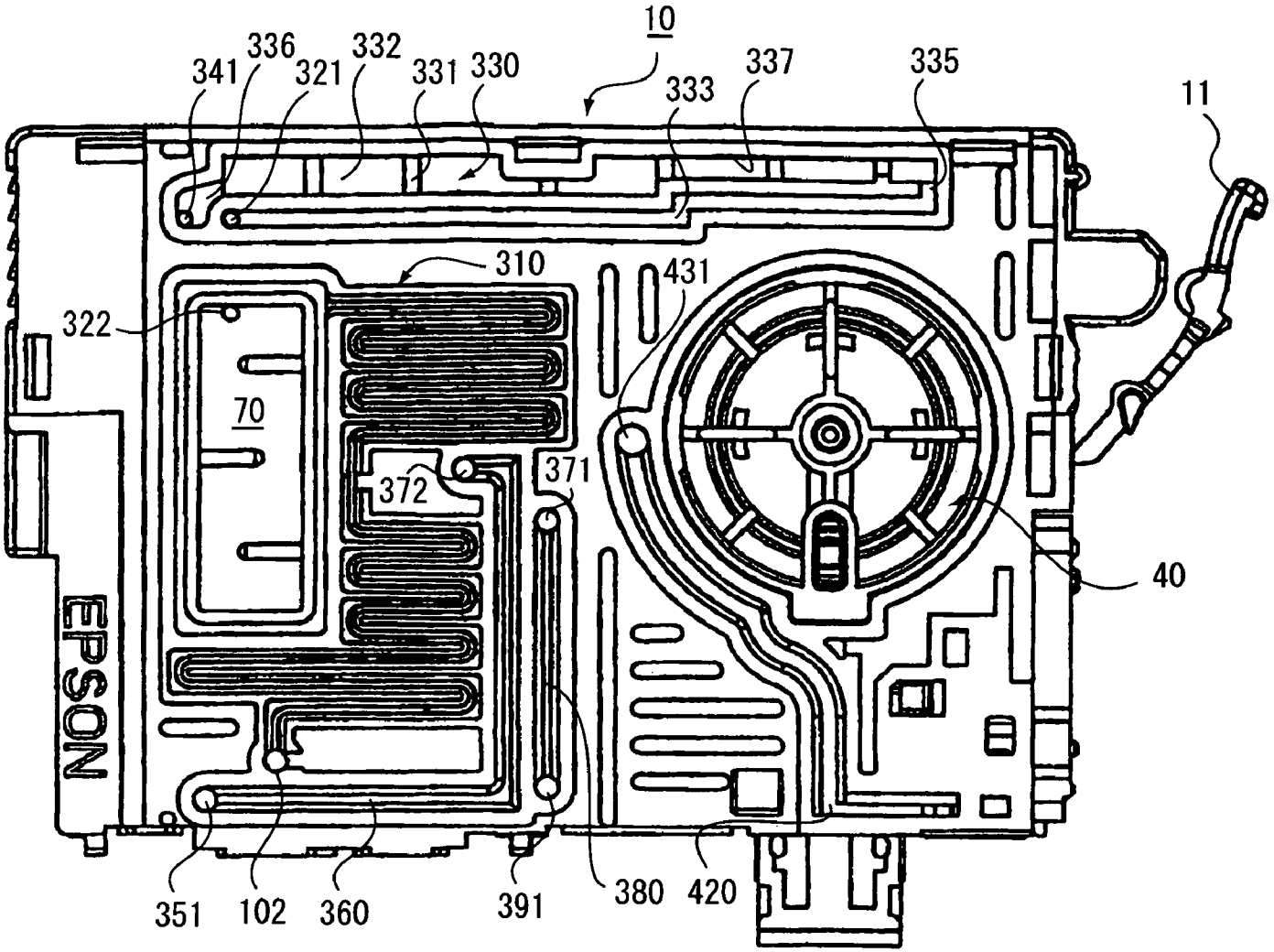
FIG. 9 is a diagram of the cartridge main body of the ink cartridge according to the embodiment of the invention as viewed from the rear surface side.
Figure 10A:
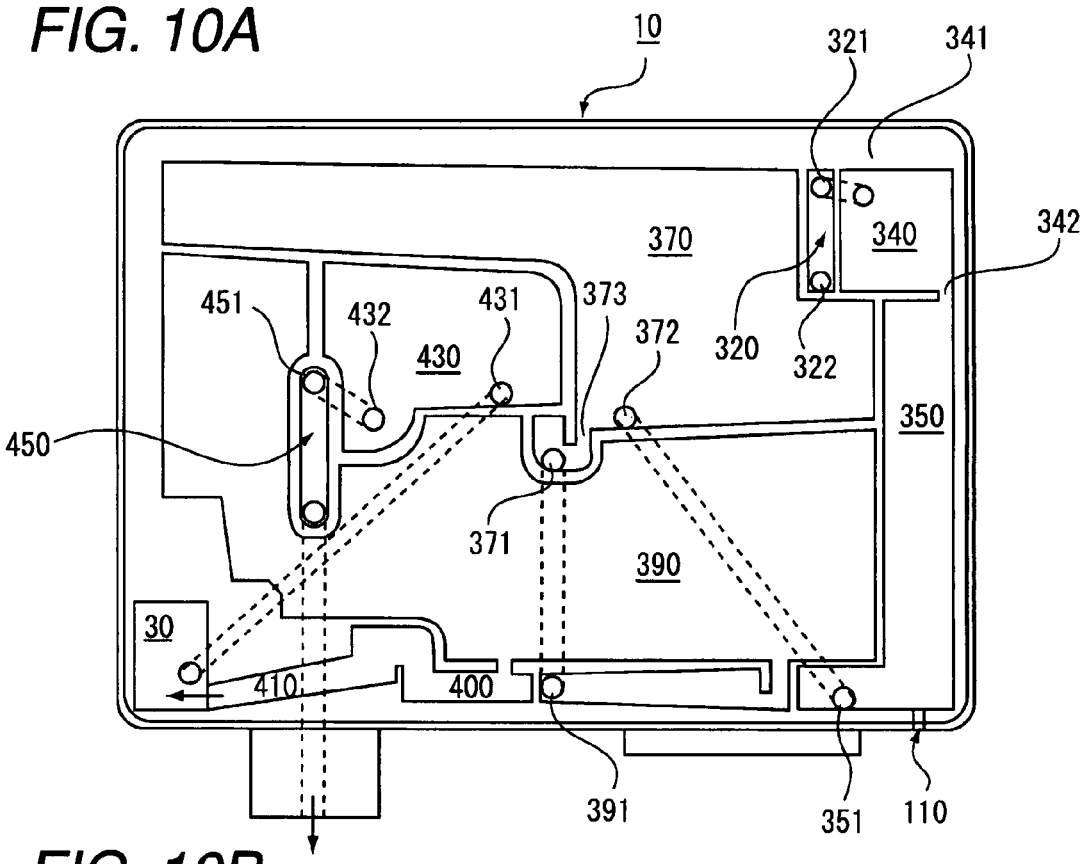
FIGS. 10A and 10B are schematic views of FIGS. 8 and 9.
Figure 10B:
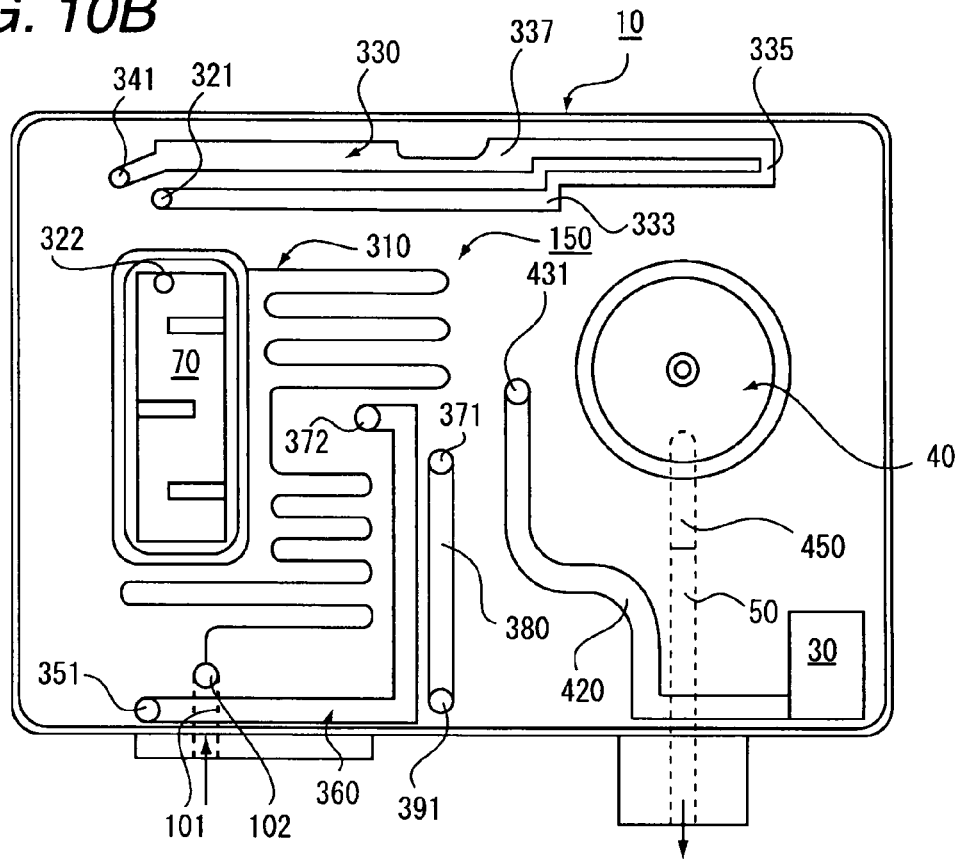
Figure 11:
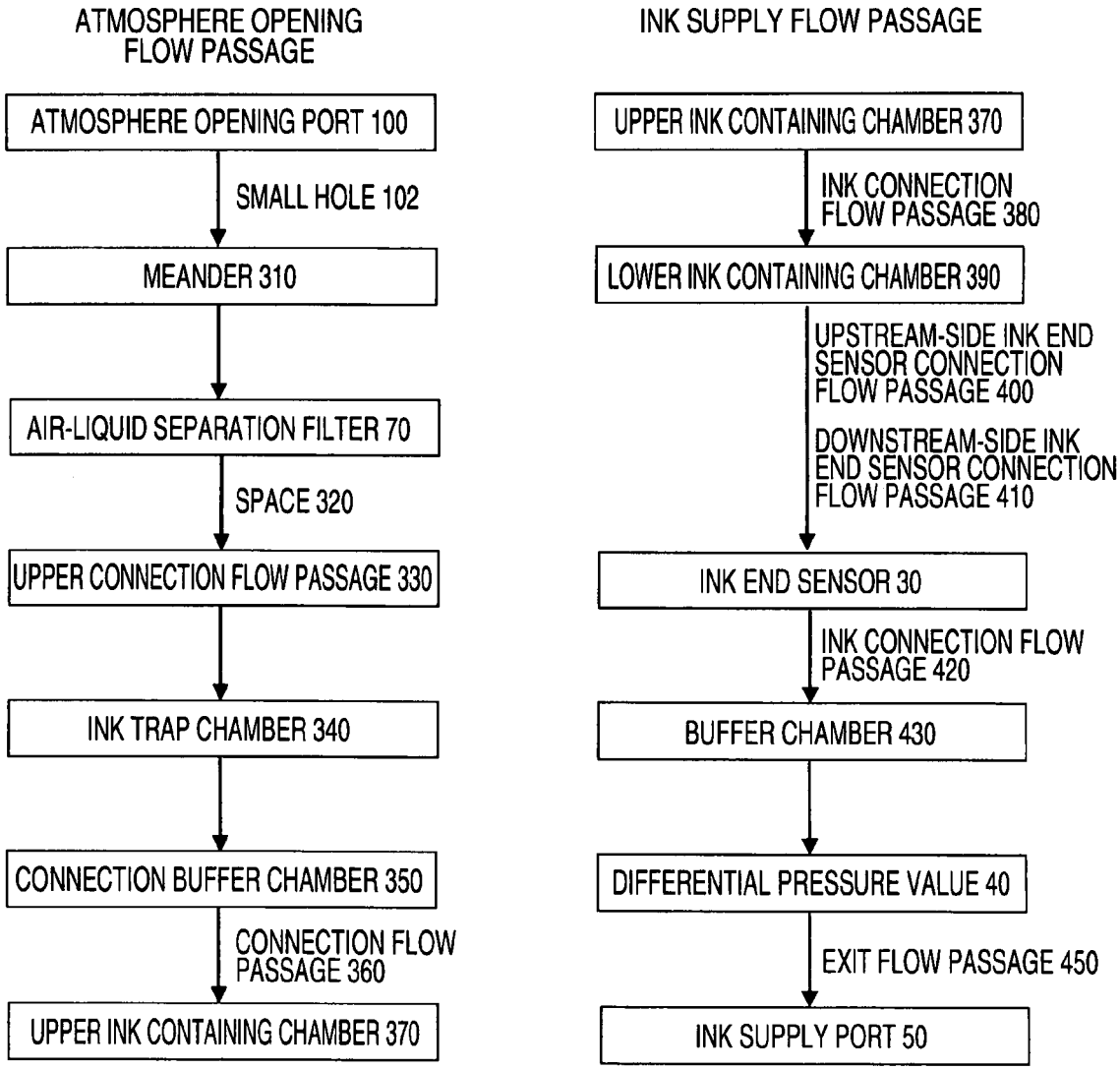
FIG. 11 is a conceptual view of a flow passage structure.
Figure 12:
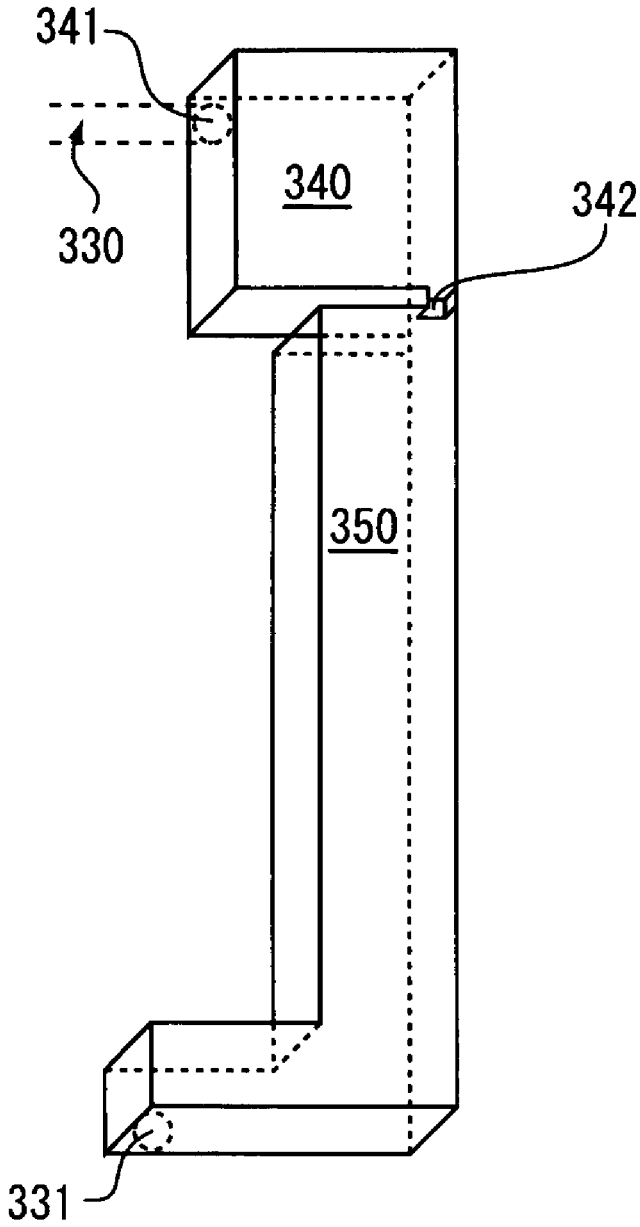
FIG. 12 is a partially enlarged perspective view of FIG. 10.

FIG. 8 is a diagram of the cartridge main body in the ink cartridge according to this embodiment as viewed from the front surface side. FIG. 9 is a diagram of the cartridge main body in the ink cartridge according to this embodiment as viewed from the rear surface side. FIG. 10 is a schematic view of FIGS. 8 and 9. FIG. 11 is a conceptual view of a flow passage structure. FIG. 12 is a partially enlarged perspective view of FIG. 10.

In the ink cartridge 1 of this embodiment, an upper ink containing chamber 370 and a lower ink containing chamber 390, which are divided into upper and lower parts, as the main ink containing chamber, and a buffer chamber 430 are formed on the front surface side. Further, an atmosphere opening flow passage 150 is formed on the rear surface side. The ink containing chambers 370 and 390 and the buffer chamber 430 are partitioned by the ribs 10*a*, and communicate with ink connection flow passages 380 and 420 formed on the rear surface side via through holes that pass through the cartridge main body 10 in a thickness direction. Then, ink can move between the ink containing chambers through the ink connection flow passages 380 and 420.

Hereinafter, the ink flow passage from the upper ink containing chamber 370 as the main ink containing chamber to the ink supply port 50 will be first described with reference to FIGS. 8 to 11.

As shown in FIG. 8, the upper ink containing chamber 370 is an ink containing region that is formed on the front surface side of the ink containing chamber to occupy approximately half of the ink containing chamber. The upper ink containing chamber 370 is formed in an upper portion from approximately half of the cartridge main body 10. A through hole 371 is formed below the upper ink containing chamber 370 to communicate with the ink connection flow passage 380. The through hole 371 is formed in the vicinity of a position that is closest to the bottom surface of the rib 11*a* forming the upper ink containing chamber 370. Even though the amount of ink in the upper ink containing chamber 370 becomes small, the through hole 371 is located below the liquid level.

As shown in FIG. 9, the ink connection flow passage 380 is formed on the rear surface side of the cartridge main body 10 to guide ink to the lower ink containing chamber 390.

As shown in FIG. 8, the lower ink containing chamber 390 is an ink containing region that is provided on the front surface side of the cartridge main body 10 to occupy approximately half of the ink containing chamber. The lower ink containing chamber 390 is formed in a lower portion from approximately half of the cartridge main body 10. A through hole 391 is formed below the lower ink containing chamber 390 to communicate with the ink connection flow passage 380. The through hole 391 is formed in the vicinity of a position that is closest to the bottom surface of the rib 10*a* forming the lower ink containing chamber 390.

The lower ink containing chamber 390 communicates with an upstream-side ink end sensor connection flow passage 400 by a through hole (not shown). A labyrinth flow passage is three-dimensionally formed in the upstream-side ink end sensor connection flow passage 400. Air bubbles that flow in the labyrinth flow passage before the ink end are caught by the labyrinth flow passage, and thus the air bubbles do not flow the downstream side.

The upstream-side ink end sensor connection flow passage 400 communicates with a downstream-side ink end sensor connection flow passage 410 by a through hole (not shown). Ink is guided to the ink end sensor 30 through the downstream-side ink end sensor connection flow passage 410.

Ink that is guided to the ink end sensor 30 is then guided to an ink connection flow passage, which is formed on the rear surface side of the cartridge main body 10, through a flow passage in the ink end sensor 30. The ink connection flow passage 420 is formed to obliquely guide ink upward from the ink end sensor 30, and connected to a through hole 431 that communicates with the buffer chamber 430. Accordingly, ink that comes out of the ink end sensor 30 is guided to the buffer chamber 430 through the ink connection flow passage 420.

The buffer chamber 430 is a small room that is defined by the rib 10*a* between the upper ink containing chamber 370 and the lower ink containing chamber 390. The buffer chamber 430 is formed as an ink storage space in front of the differential pressure valve 40. The buffer chamber 430 is formed to face the rear side of the differential pressure valve 40, such that ink flows into the differential pressure valve 40 via a through hole 432.

Ink that flows into the differential pressure valve 40 is guided to the downstream side by the differential pressure valve 40 and then guided to an exit flow passage 450 via a through hole 451. The exit flow passage 450 communicates with the ink supply port 50, such that ink is supplied to the ink jet printer through the ink supply needle 240 that is inserted into the ink supply port 50.

Next, the atmosphere opening flow passage 150 from the atmosphere opening port 100 to the upper ink containing chamber 370 will be described with reference to FIGS. 8 to 12.

If ink in the ink cartridge 1 is consumed and the pressure in the ink cartridge 1 is lowered, the atmosphere (air) flows from the atmosphere opening port 100 into the ink cartridge 1 by the amount of decreased ink.

The small hole 102 that is provided in the atmosphere opening port 100 communicated with one end of a meander 310 that is formed on the rear surface side of the cartridge main body. The meander 310 is a meandering path that is formed thin and long to extend a distance from the atmosphere opening port 100 to the upper ink containing chamber 370, thereby suppressing evaporation of moisture in ink. The other end of the meander 310 is connected to the air-liquid separation filter 70.

A through hole 22 is formed at the bottom surface of the air-liquid separation chamber 70*a* constituting the air-liquid separation filter 70 and communicates with a space 320, which is formed on the front surface side of the cartridge main body 10, via the through hole 322. In the air-liquid separation filter 70, the air-liquid separation film 71 is disposed between the through hole 322 and the other end of the meander 310. The air-liquid separation film 71 is formed by weaving a fiber material having high water-repellency and oil-repellency.

The space 320 is formed in an upper right portion of the upper ink containing chamber as viewed from the front surface side of the cartridge main body 10. In the space 320, a through hole (air inlet hole) 321 is formed above the through hole 322. The space 320 communicates to an upper connection flow passage 330, which is formed on the rear surface side, via the through hole 321.

The upper connection flow passage 330 is configured to pass through the top surface of the ink cartridge 1, that is, the uppermost portion in the gravity direction in a state where the ink cartridge 1 is attached. Specifically, the upper connection flow passage 330 has a flow passage portion 333 that extends from the through hole 321 rightward along the long side as viewed from the rear surface side, and a flow passage 337 that is folded back from a folded portion 335, passes through the top surface of the ink cartridge 1 farther than the flow passage portion 333, and extends to a through hole 341 formed in the vicinity of the through hole 321. Moreover, the through hole 341 communicates with the ink trap chamber (liquid trap chamber) 340 that is formed on the front surface side.

Here, when the upper connection flow passage 330 is viewed from the rear surface side, a position 336 where the through hole 341 is formed, and a concave portion 332 that is dug deep in a cartridge thickness direction farther than the position 336 are provided in the flow passage portion 337 that extends from the folded portion 335 to the through hole 341. Further, a plurality of ribs 331 are formed to partition the concave portion 332. In addition, the flow passage portion 333 that extends from the through hole 321 to the folded portion 335 is formed shallower than the flow passage portion 337 that extends from the folded portion 335 to the through hole 341.

In this embodiment, since the upper connection flow passage 330 is formed in the uppermost portion in the gravity direction, basically, ink does not move to the atmosphere opening port 100 beyond the upper connection flow passage 330. Further, the upper connection flow passage 330 has a large size to such a degree as not to cause backflow of ink due to a capillary phenomenon and the concave portion 332 is formed in the flow passage portion 337, such that ink that flows backward is easily caught therein.

The ink trap chamber 340 is a rectangular parallelepiped space that is formed at an upper right corner of the cartridge main body 10 as viewed from the front surface side. As shown in FIG. 12, the through hole 341 is formed in the vicinity of an upper left corner on the back side of the ink trap chamber 340 as viewed from the front surface side. Further, a cut portion (air outlet hole) 342 is formed at a lower right corner on the front side of the ink trap chamber 340 by cutting a portion of the rib 10*a* as a partition. The ink trap chamber 340 communicates with a connection buffer chamber 350 through the cut portion 342. Even though ink flows from the upper ink containing chamber 370 backward, the ink trap chamber 340 and the connection buffer chamber 350 retain ink such that ink does not flow into the atmosphere opening port 100 anymore. The specific operations of the ink trap chamber 340 and the connection buffer chamber 350 will be described below.

The connection buffer chamber 350 is a space that is formed below the ink trap chamber 340. The decompression hole 110 is formed at a bottom surface 352 of the connection buffer chamber 350 to pump air out upon ink injection. Further, at a lowermost position in the gravity direction near the bottom surface 352 when the ink cartridge is mounted on the ink jet printer, a through hole 351 is formed in a thickness direction. The connection buffer chamber 350 communicates with a connection flow passage 360, which is formed on the rear surface side, via the through hole 351.

The connection flow passage 360 extends upward to a central portion, and communicates with the upper ink containing chamber 370 via a through hole 372 that is formed near the bottom surface of the upper ink containing chamber 370. That is, the connection flow passage 360 from the atmosphere opening port 100 forms the atmosphere opening flow passage 150 of this embodiment. The connection flow passage 360 is formed thin to such a degree as to form a meniscus and not to cause backflow of ink.

Next, the ink leakage prevention structure according to the invention will be described.

Ink is usually filled until the upper ink containing chamber 370 is filled to 60%, and ink is not filled to the connection buffer chamber 350. Basically, since the individual connection flow passages are thin to such a degree as to secure the intensity of the meniscus, in which air and ink are not replaced with each other, ink does not flow in the connection buffer chamber 350.

However, if air in the upper ink containing chamber 370 thermally expands, for example, due to a change in temperature from a normal temperature to a high temperature, ink may flow in the connection flow passage 360 backward. In this case, ink may flow into the connection buffer chamber 350. In contrast, in this embodiment, since the through hole 351 is formed in the lowermost portion of the connection buffer chamber 350, a small amount of ink flows backward, the connection buffer chamber 350 functions as a buffer that receives ink flowing backward. Accordingly, ink does not flow into the ink trap chamber 340, and thus ink does not leak to the atmosphere opening port 100.

Further, if the ink cartridge is detached in a state where ink exists in the connection buffer chamber 350 and left unmounted, ink does not leak to the atmosphere opening port 100.

FIGS. 13A to 13E are schematic views illustrating the effects of the ink leakage prevention structure that is formed by the ink trap chamber 340 and the peripheral structures thereof. In FIGS. 13A to 13E, the upper side of the paper is an upper side in the gravity direction, and the lower side of the paper is a lower side in the gravity direction (falling direction).

The ink leakage prevention structure will be specifically described with reference to FIGS. 13A to 13E.

Figure 13A:
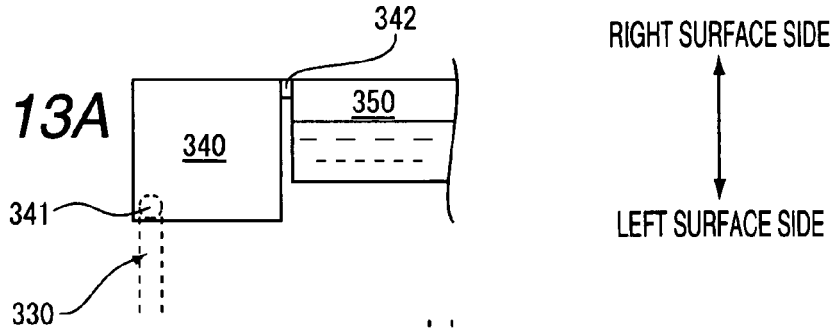
FIGS. 13A to 13E are schematic views illustrating the effects of an ink leakage prevention structure that is formed by an ink trap chamber and peripheral structures thereof in the ink cartridge according to the embodiment of the invention.

First, as shown in FIG. 13A, a case where the ink cartridge 1 is disposed such that the left surface side of the ink cartridge 1 is downward in the gravity direction is considered. In this case, even though ink enters the connection buffer chamber 350 due to a change in temperature from a normal temperature to a high temperature, if ink flows backward to such a degree as to fill the connection buffer chamber 350, ink cannot enter the ink trap chamber 340 from the connection buffer chamber 350 beyond the cut portion 342. Accordingly, ink cannot flow into the atmosphere opening port 100 farther than the front side of the ink trap chamber 340. Therefore, ink leakage can be prevented.

Figure 13B:
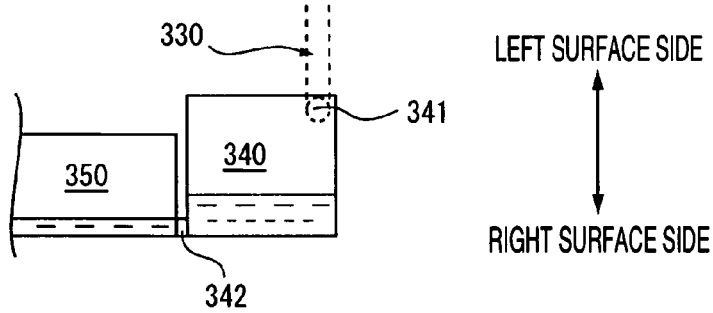

Next, as shown in FIG. 13B, a case where the ink cartridge 1 is disposed such that the right surface side of the ink cartridge 1 is downward in the gravity direction is considered. In this case, if ink enters the connection buffer chamber 350, ink enters the ink trap chamber 340 from the connection buffer chamber 350 beyond the cut portion 342. However, since the through hole 341 that connects the ink trap chamber 340 and the upper connection flow passage 330 exists at a corner facing the cut portion 342, ink cannot flow into the upper connection flow passage 330. Further, in a case where the ink cartridge 1 is disposed such that the right surface side of the ink cartridge 1 is downward in the gravity direction, the upper connection flow passage 330 extends from the through hole 341 upward in the gravity direction. Accordingly, even though ink is filled in the ink trap chamber 340, ink does not flow into the flow passage portion 333. Therefore, ink cannot flow into the atmosphere opening port 100 farther than the flow passage portion 333. As a result, ink leakage can be prevented.

Figure 13C:
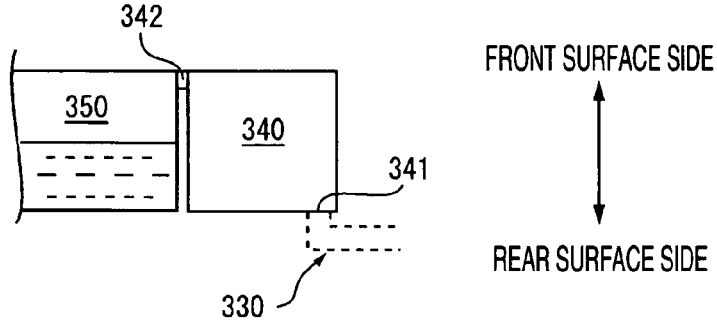

Next, as shown in FIG. 13C, a case where the ink cartridge 1 is disposed such that the rear surface side of the ink cartridge 1 is downward in the gravity direction is considered. In this posture, ink of the upstream-side ink containing chamber is dammed by the cut portion 342 (dam portion) and does not flow out to the connection buffer chamber 350. Further, even though ink enters the connection buffer chamber 350, if ink does not flow backward to such a degree as to fill the connection buffer chamber 350, ink cannot enter the ink trap chamber 340 from the connection buffer chamber 350 beyond the cut portion 342. Therefore, ink cannot flow into the atmosphere opening port 100 farther than the front side of the ink trap chamber 340. As a result, ink leakage can be prevented.

Figure 13D:
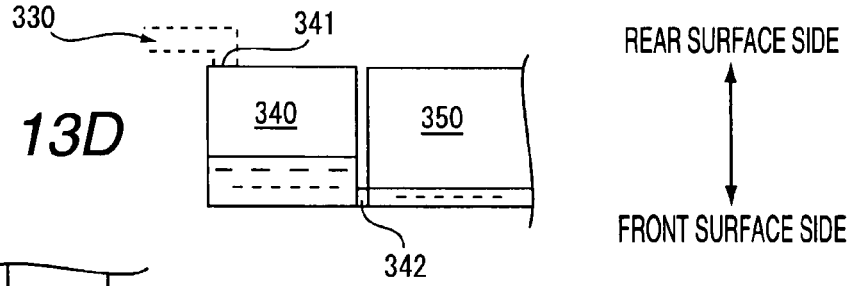

Next, as shown in FIG. 13D, a case where the ink cartridge 1 is disposed such that the front surface side of the ink cartridge 1 is downward in the gravity direction is considered. In this case, if ink enters the connection buffer chamber 350, ink enters the ink trap chamber 340 from the connection buffer chamber 350 beyond the cut portion 342. However, since the through hole 341 that connects the ink trap chamber 340 and the upper connection flow passage 330 exists at a corner facing the cut portion 342, ink cannot flow into the upper connection flow passage 330.

Further, in a posture shown in FIG. 13D, even though the ink trap chamber 340 is filled with ink and ink flows into the upper connection flow passage 330, since the depthwise direction of the concave portion 332 formed in the upper connection flow passage 330 is downward in the gravity direction, ink is dammed by the rib 331 and does not flow into the through hole 321. Therefore, ink cannot flow into the atmosphere opening port 100 farther than the flow passage portion 333 at a maximum, and thus ink leakage can be prevented.

Figure 13E:
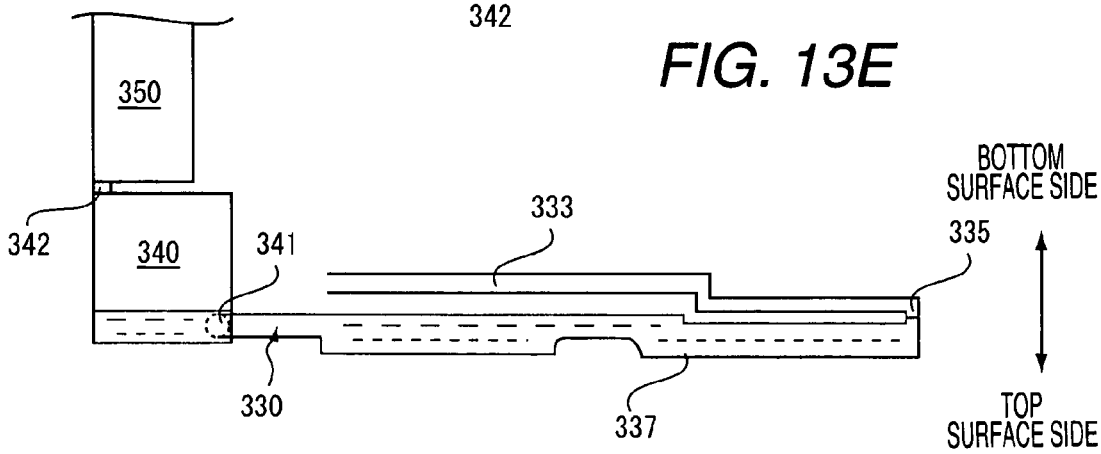

Next, as shown in FIG. 13E, a case where the ink cartridge 1 is disposed such that the top surface side of the ink cartridge 1 is downward in the gravity direction is considered. In this posture, since the liquid level of the upstream-side ink containing chamber 370 is lower than the through hole 372, ink does not flow out to the connection buffer chamber 350. Further, if ink enters the connection buffer chamber 350, ink enters the ink trap chamber 340 from the connection buffer chamber 350 beyond the cut portion 342. Then, ink enters the upper connection flow passage 330 from the ink trap chamber 340 via the through hole 341.

However, in a state where the ink cartridge 1 is disposed such that the top surface side of the ink cartridge 1 is downward in the gravity direction, in the upper connection flow passage 330, the flow passage portion 337 of that connects the folded portion 335 and the through hole 341 is located below the flow passage portion 333 that connects the folded portion 335 and the through hole 321. Accordingly, ink does not enter the flow passage portion 333 beyond the folded portion 335. Therefore, ink cannot flow into the atmosphere opening port 100 farther than the upper connection flow passage 330 at a maximum. As a result, ink leakage can be prevented.

In an arbitrary posture, even though a small amount of ink flows out to the atmosphere opening port 100 beyond the upper connection flow passage 330, since the air-liquid separation filter 70 is provided between the atmosphere opening port 100 and the upper connection flow passage 330, ink does not leak to the atmosphere opening port 100 beyond the air-liquid separation filter 70. Therefore, for practical use, ink leakage from the atmosphere opening port 100 can be sufficiently suppressed as a whole.

When ink flows out to the ink trap chamber 340 due to thermal expansion or the like, if the ink cartridge 1 is mounted on the carriage 200 in a state where the bottom surface turns downward, and ink is consumed, ink returns from the upper connection flow passage 330 or the ink trap chamber 340 to the connection buffer chamber 350. Since the through hole 351 is formed near the bottom surface, ink that returns to the connection buffer chamber 350 can easily return to the upper ink containing chamber 370 via the through hole 351. Therefore, even though ink flows out from the upper ink containing chamber 370 to the atmosphere opening port 100, ink can be used for image recording with no waste.

When the ink jet printer itself is left in a posture other than a normal posture and is being transported, the same effects as when the ink cartridge is detached and left unmounted can be obtained. That, even though the ink jet printer is left in any postures and the temperature changes, ink leakage from the atmosphere opening port 100 can be prevented. Further, when used (normal posture), ink that flows out to the atmosphere opening port 100 returns to the upper ink containing chamber as ink is consumed, and thus ink can be used for image recording.

As described above, according to the ink cartridge 1 of this embodiment, since the atmosphere opening port 100 is formed on the same plane as the ink supply port 50, it is not necessary to use a complex mold having a pattern for forming holes at a plurality of surfaces when the ink cartridge 1 is molded. Therefore, a manufacturing process is simplified and manufacturing costs are suppressed.

According to the ink cartridge 1 of this embodiment, in order to suppress ink leakage when the atmosphere opening port 100 is provided downward in the gravity direction, the ink trap chamber 340 is provided in the atmosphere opening flow passage 150 to prevent ink leakage from the atmosphere opening port 100. Therefore, even though ink flows out from the upper ink containing chamber 370 to the atmosphere opening port 100 due to thermal expansion or the like, ink is reliably trapped by the ink trap chamber 340, and thus ink leakage can be prevented from occurring. Further, since ink that is trapped by the ink trap chamber 340 flows into the upper ink containing chamber 370 as the liquid is consumed, ink contained therein can be used with no waste.

The ink cartridge 1 of this embodiment can be suitably used for a liquid container having a differential pressure valve 40. That is, in the liquid container having the differential pressure valve 40, ink leakage from the atmosphere opening port may occur, compared with the liquid container having a foam as a negative pressure generation device. In this case, however, with the ink trap chamber 340, liquid leakage can be reliably prevented.

According to the ink cartridge 1 of this embodiment, in at least a portion of the atmosphere opening flow passage 150, the upper connection flow passage 330 that passes through the uppermost portion of the ink cartridge in the gravity direction is provided. Therefore, even though ink flows backward, ink does not reach the atmosphere opening port 100 beyond the uppermost portion in the gravity direction. As a result, ink leakage can be suppressed.

According to the ink cartridge 1 of this embodiment, when ink flows out to the atmosphere opening port 100, since the air-liquid separation filter 70 is provided in front of the atmosphere opening port 100, ink does not leak to the atmosphere opening port 100 beyond the air-liquid separation filter 70. Therefore, ink leakage from the atmosphere opening port 100 can be more reliably suppressed.

The label that indicates the model number or the kind of the liquid is provided substantially all over the surface of the cartridge main body 10 facing the surface where the atmosphere opening port 100 is formed. Like this embodiment, if the atmosphere opening port 100 is provided at the lower surface in the gravity direction, any structure does not need to be provided on the top surface. Therefore, the surface of the cartridge main body 10 facing the surface where the atmosphere opening port 100 is formed can be efficiently used, and a label that is easily recognized by the user can be adhered thereto. As a result, the ink cartridge 1 can be prevented from being erroneously attached.

Next, an unremoval prevention structure of the sealing film 90 will be described.

The concave portion 101 of the atmosphere opening port 100 has a depth to such a degree as to receive the protrusion 230 formed in the carriage 200. The protrusion 230 is an unremoval prevention protrusion that prevents unremoval of the sealing film 90 sealing the atmosphere opening port 100. That is, in a state where the sealing film 90 is adhered, the protrusion 230 is not inserted into the atmosphere opening port 100, and thus the ink cartridge 1 is not attached to the carriage 200. Accordingly, even though the user tries to attach the ink cartridge 1 to the carriage 200 in a state where the sealing film 90 is adhered onto the atmosphere opening port 100, the ink cartridge 1 is not attached to the carriage 200. Then, the user can be urged to surely remove the sealing film 90 when the ink cartridge 1 is mounted.

Here, the depth of the concave portion 101 is a depth to such a degree that the protrusion 230 interferes with the bottom surface of the concave portion in a state where the ink cartridge 1 is mounted on the carriage 200. Specifically, if the length of the protrusion 230 is approximately 3 mm, the depth (a length in a convex portion approach direction) is, for example, 5 mm or more.

Moreover, in the above-described embodiment, the protrusion 230 serving as the unremoval prevention protrusion is inserted into the concave portion 101 that constitutes the atmosphere opening port 100, then the sealing film 90 adhered onto the atmosphere opening port 100 is removed, and subsequently the ink cartridge 1 is mounted. However, the invention is not limited thereto. For example, a concave portion that receives the unremoval prevention protrusion may be provided separately from the atmosphere opening port, and the atmosphere opening port and the concave portion may be sealed with the sealing film 90 together, thereby implementing unremoval prevention.

Figure 14A:
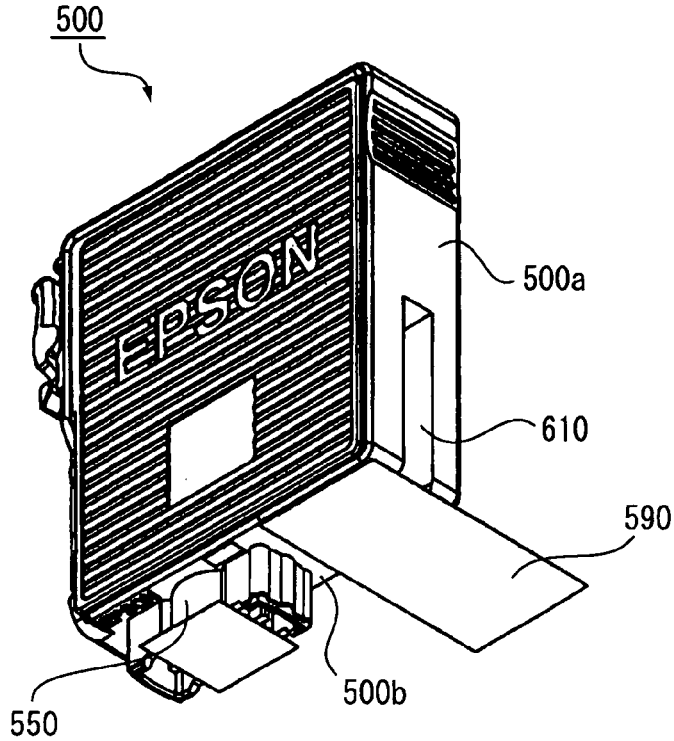
FIGS. 14A and 14B are perspective views showing another example of an ink cartridge according to the invention.
Figure 14B:
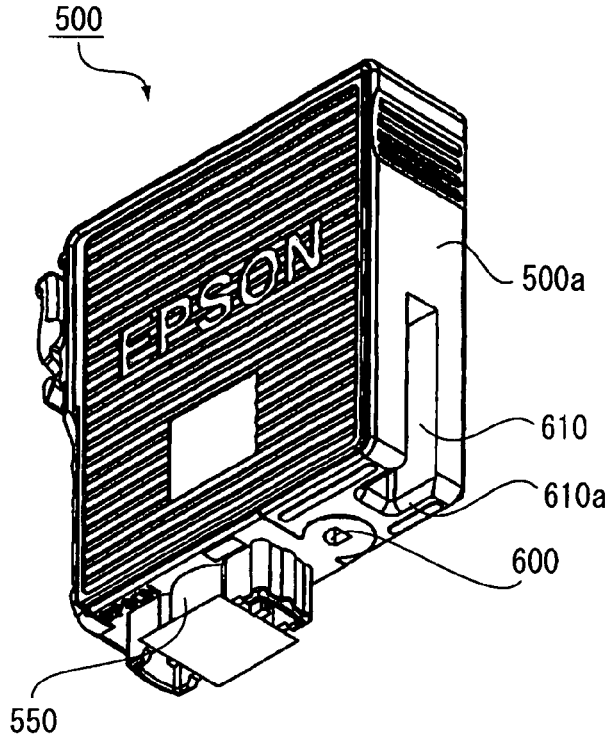

FIGS. 14A and 14B are perspective views showing an ink cartridge 1 as a modification of the above-described embodiment.

As shown in FIGS. 14A and 14B, an ink cartridge 500 of this modification is a small ink cartridge that is smaller than the ink cartridge 1 of the above-described embodiment shown in FIG. 1.

In view of basic design, the ink cartridge 500 is the same as the ink cartridge 1. Specifically, an ink supply port 550 and an atmosphere opening port 600 are provided at a bottom surface 500*b*. Further, in the ink cartridge 500, upon manufacturing, the atmosphere opening port 600 is covered and sealed with a sealing film 590. Then, before used, that is, before the ink cartridge 500 is mounted on the ink jet printer, the sealing film 590 is removed to communicate the atmosphere opening flow passage of the ink cartridge 500 with the atmosphere.

In the ink cartridge 500, a groove 610 is formed as the concave portion that receives the unremoval prevention protrusion provided in the carriage. The groove 610 is formed from the bottom surface 500*b* of the ink cartridge 500 toward the top surface along a right surface 500*a*. The groove 610 is formed close to the atmosphere opening port 600. Before the ink cartridge 500 is used, as shown in FIG. 14A, a lower surface-side opening 610*a* is covered with the sealing film 590 together with the atmosphere opening port. Moreover, the length and the depth of the groove 610 may vary according to the kind of ink, and thus the groove 610 may function as an erroneous insertion prevention protrusion for correctly mounting a plurality of cartridges.

Figure 15:
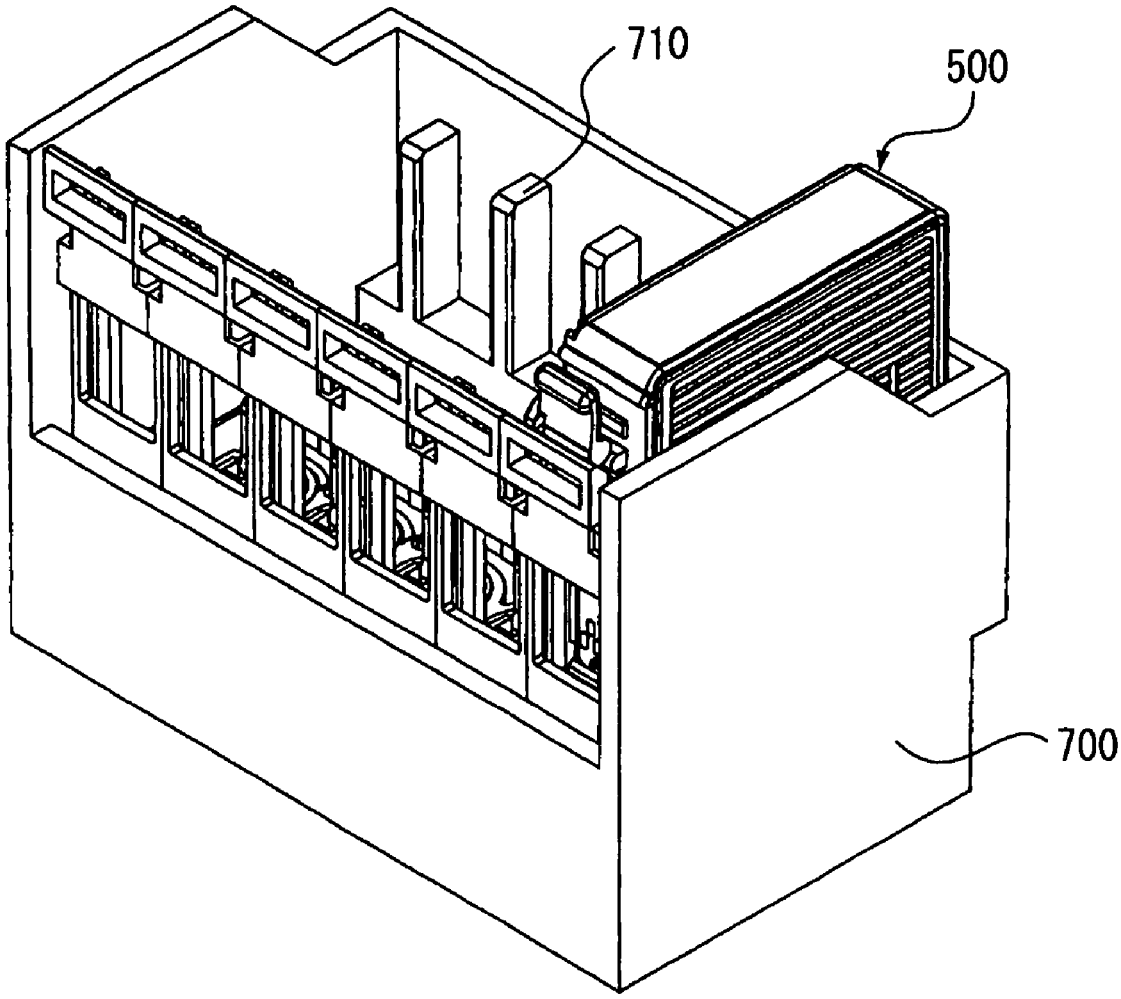
FIG. 15 is a perspective view showing a carriage of an ink jet printer on which an ink cartridge is mounted.
Figure 16:
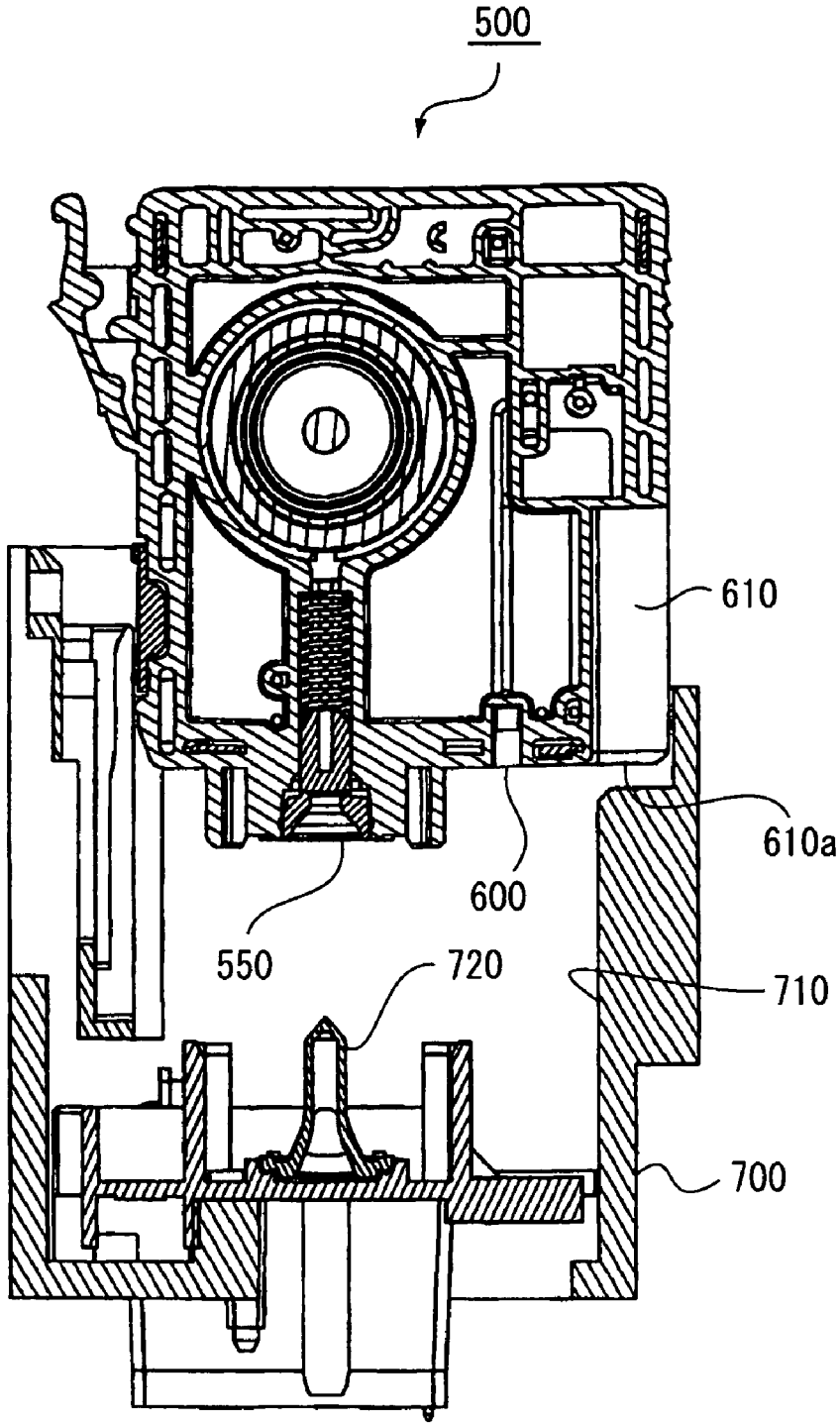
FIG. 16 is a cross-sectional view showing a state immediately before an ink cartridge is mounted.
Figure 17:
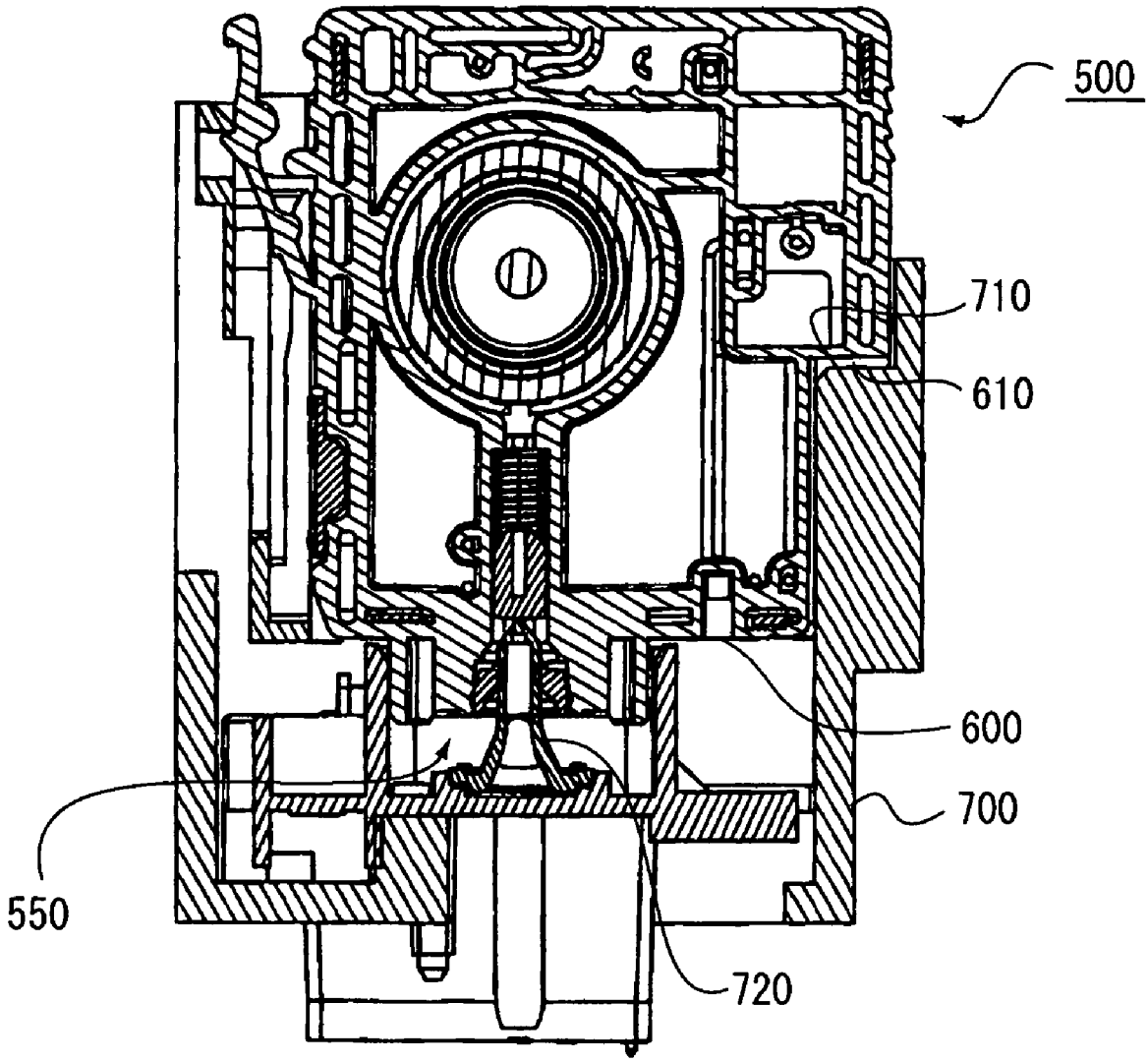
FIG. 17 is a cross-sectional view showing a state immediately after an ink cartridge is mounted.

FIG. 15 is a perspective view of a carriage of an ink jet printer on which the ink cartridge is mounted. FIG. 16 is a cross-sectional view showing a state immediately before the ink cartridge is mounted. FIG. 17 is a cross-sectional view showing a state immediately after the ink cartridge is mounted.

As shown in FIG. 15, a carriage 700 has a rib 710 that is provided to correspond to the groove 610. As shown in FIG. 16, when the ink cartridge 500 is mounted, the rib 710 is inserted from the lower surface-side opening 610*a* of the groove 610, and an ink supply needle 720 is inserted into an ink supply port 550. Then, as shown in FIG. 17, the ink cartridge 500 is mounted on the carriage 700. Here, the shape of the rib 710 and the shape of the groove 610 are substantially the same. When the ink cartridge 500 is mounted, the groove 610 functions as a guide groove that guides the rib 710 such that the ink cartridge 500 is mounted on the carriage 700.

Here, if the sealing film 590 that covers the atmosphere opening port 600 and the groove 610 together is not removed, the sealing film 590 that is adhered onto the lower surface-side opening 610*a* interferes with the rib 710, and the ink supply needle 720 cannot be inserted into the ink supply port 550. Accordingly, when the ink cartridge 500 is attached to the carriage 700, it is necessary to remove the sealing film 590. Therefore, a case where the ink cartridge 500 is attached to the carriage 700 in a state where the atmosphere opening port 600 is sealed can be avoided.

Here, the length of the groove 610 in a rib approach direction (the length of the groove from the lower surface-side opening 610*a* toward the top surface) is a depth to such a degree such that the rib 710 does not interfere with the bottom surface of the concave portion in a state where the ink cartridge 500 is mounted on the carriage 700. Specifically, if the length of the rib 710 is approximately 8 mm, the depth (the length in the rib approach direction) is, for example, 10 mm or more.

As such, in this modification, with the groove 610, the same advantages and effects of the concave portion formed in the atmosphere opening port of the above-described embodiment can be obtained.

The entire disclosure of Japanese Patent Application Nos: 2006-83051, filed Mar. 24, 2006 and 2006-83052, filed Mar. 24, 2006 are expressly incorporated by reference herein.

While this invention has been described in conjunction with the specific embodiments thereof, it is evident that many alternatives, modifications, and variations will be apparent to those skilled in the art. Accordingly, preferred embodiments of the invention as set forth herein are intended to be illustrative, not limiting. There are changes that may be made without departing from the sprit and scope of the invention.

What is claimed is:

1. A liquid container comprising:

a first surface side and a second surface side opposite to the first surface side;

a liquid containing chamber for containing a liquid therein;

a liquid supply port for connecting to a liquid receiving portion of an apparatus and supplying the liquid to the apparatus;

an atmosphere opening port provided to be located at a lower surface of the liquid container in a gravity direction when the liquid container is mounted on the apparatus; and an atmosphere opening flow passage connecting the atmosphere opening port and the liquid containing chamber, the atmosphere opening flow passage comprising:

a liquid trap chamber provided on an upper portion of the liquid container in the gravity direction;

a first part of the atmosphere opening flow passage connecting the atmosphere opening port and the liquid trap chamber; and a second part of the atmosphere opening flow passage connecting the liquid trap chamber and the liquid containing chamber, the second part of the atmosphere opening flow passage comprising a connection buffer chamber provided below the liquid trap chamber and comprising a connection flow passage extending upward to connect a lower part of the buffer chamber and the liquid containing chamber, in the gravity direction.

2. The liquid container according to claim 1, further comprising:

a differential pressure valve that is provided between the liquid containing chamber and the liquid supply port to set a pressure of the liquid to be supplied to the liquid supply port in a negative pressure state.

3. The liquid container according to claim 1, wherein at least a portion of the first part of the atmosphere opening flow passage passes through an uppermost portion of the liquid container in the gravity direction.

4. The liquid container according to claim 1, further comprising:

an air-liquid separation filter that is provided in the first part of the atmosphere opening flow passage to transmit air but block the liquid.

5. The liquid container according to claim 1, wherein, a label that indicates a model number or the kind of the liquid is provided substantially all over a surface of the liquid container opposite to a surface where the atmosphere opening port is formed.

6. The liquid container according to claim 1, wherein the liquid containing chamber includes an upper liquid containing chamber and a lower liquid containing chamber, and the connection buffer chamber is connected to the upper liquid containing chamber.

7. The liquid container according to claim 6, wherein the connection buffer chamber is connected to a bottom portion of the upper liquid containing chamber.

8. The liquid container according to claim 1, further comprising a dam portion between the liquid trap chamber and the connection buffer chamber.

9. The liquid container according to claim 1, wherein an air inlet hole and an air outlet hole of the liquid trap chamber are located offset with respect to a direction perpendicular to an insertion direction when the liquid container is attached to the apparatus.

10. The liquid container according to claim 1, further comprising a sealing film that is adhered to close the atmosphere opening port and is removable before the liquid container is attached to the apparatus.

11. The liquid container according to claim 1, further comprising a differential pressure valve that is provided between the liquid containing chamber and the liquid supply port.

12. The liquid container according to claim 1, further comprising a decompression hole connecting to the connection buffer chamber.

13. The liquid container according to claim 1, wherein the atmosphere opening flow passage comprises a concave portion formed at a plane where the atmosphere opening port is formed, into which a convex portion of the apparatus can be fitted, and wherein the sealing film the concave portion and the atmosphere opening port are sealed together by a sealing film removable before the liquid container is connected to the apparatus.

14. The liquid container according to claim 13, wherein at least a portion of the first part of the atmosphere opening flow passage passes through an uppermost portion of the liquid container in a gravity direction.

15. The liquid container according to claim 13, wherein an air-liquid separation filter that transmits air but blocks the liquid is provided in the first part of the atmosphere opening flow passage.

16. The liquid container according to claim 13,
wherein the concave portion is a hole, and the hole forms the atmosphere opening port.

17. The liquid container according to claim 16,
wherein a length of the hole is 5 mm or more in an approaching direction of the convex portion.

18. The liquid container according to claim 13,
wherein the concave portion is a guide groove for guiding the convex portion of the apparatus to mount the liquid container on the apparatus.

19. The liquid container according to claim 18,
wherein the length of the guide groove is 10 mm or more in an approaching direction of the convex portion.

20. The liquid container according to claim 13,
wherein the liquid container is packed in a compressed pack that is compressed and sealed to have an internal air pressure equal to or less than an atmospheric pressure.

21. The liquid container according to claim 13, wherein the convex portion of the apparatus is an erroneous insertion preventing projection for mounting the liquid container in a correct position, and the concave portion can accept the erroneous insertion preventing projection when the liquid container is correctly mounted to the apparatus.

* * * * *